US011795773B2

(12) United States Patent
Garcia

(10) Patent No.: US 11,795,773 B2
(45) **Date of Patent: *Oct. 24, 2023**

(54) DEBRIS COLLECTION TOOL

(71) Applicant: Weatherford Technology Holdings, LLC, Houston, TX (US)

(72) Inventor: Matthew Daniel Garcia, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/575,528

(22) Filed: Jan. 13, 2022

(65) Prior Publication Data

US 2022/0136354 A1 May 5, 2022

Related U.S. Application Data

(63) Continuation of application No. 16/883,746, filed on May 26, 2020, now Pat. No. 11,225,851.

(51) Int. Cl.

| | |
|---|---|
| ***E21B 31/06*** | (2006.01) |
| ***H01F 7/02*** | (2006.01) |
| ***E21B 27/00*** | (2006.01) |

(52) U.S. Cl.

CPC ..... *E21B 31/06* (2013.01); *E21B 27/00* (2013.01); *H01F 7/02* (2013.01); *H01F 7/0257* (2013.01)

(58) Field of Classification Search

CPC . E21B 31/06; E21B 27/00; H01F 7/02; H01F 7/0257

See application file for complete search history.

(56) References Cited

U.S. PATENT DOCUMENTS

| | | | |
|---|---|---|---|
| 2,778,669 | A | 1/1957 | Goodwin |
| 4,059,155 | A | 11/1977 | Greer |
| 4,109,521 | A | 8/1978 | Youmans |
| 5,360,069 | A | 11/1994 | Schmuck et al. |
| 5,582,253 | A | 12/1996 | Fraser |
| 5,813,458 | A | 9/1998 | Smith, Jr. et al. |

(Continued)

FOREIGN PATENT DOCUMENTS

| | | | |
|---|---|---|---|
| EP | 2868862 | A1 | 5/2015 |
| GB | 2350632 | A | 12/2000 |

(Continued)

OTHER PUBLICATIONS

U.S. Office Action dated Feb. 3, 2022, for U.S. Appl. No. 16/805,941.

(Continued)

*Primary Examiner* — George S Gray

(74) *Attorney, Agent, or Firm* — Peter V. Schroeder; Booth Albanesi Schroeder PLLC

(57) ABSTRACT

A magnet assembly for a debris collection tool includes first and second annular end bands, between which is disposed an annular arrangement of magnets. The magnet assembly includes a plurality of bridges, each bridge disposed between the first and second annular end bands and between circumferentially adjacent magnets of the annular arrangement of magnets. The first and second annular end bands are substantially of a non-magnetic material, and the bridges are substantially of a magnetic material.

7 Claims, 25 Drawing Sheets

(56) References Cited

U.S. PATENT DOCUMENTS

| | | | |
|---|---|---|---|
| 5,839,866 | A | 11/1998 | Moen et al. |
| 6,053,244 | A | 4/2000 | Dybevik et al. |
| 6,065,536 | A | 5/2000 | Gudmestad et al. |
| 6,216,787 | B1 | 4/2001 | Ruttley |
| 6,241,018 | B1 | 6/2001 | Eriksen |
| 6,241,023 | B1 | 6/2001 | Krauss et al. |
| 6,408,945 | B1 | 6/2002 | Telfer |
| 6,439,303 | B1 | 8/2002 | Sorhus et al. |
| 6,467,547 | B2 | 10/2002 | Maguire et al. |
| 6,491,117 | B2 | 12/2002 | Ruttley |
| 6,571,880 | B1 | 6/2003 | Butterfield, Jr. et al. |
| 6,655,462 | B1 | 12/2003 | Carmichael et al. |
| 6,681,860 | B1 | 1/2004 | Yokley et al. |
| 6,739,398 | B1 | 5/2004 | Yokley et al. |
| 6,907,936 | B2 | 6/2005 | Fehr et al. |
| 7,114,573 | B2 | 10/2006 | Hirth et al. |
| 7,137,449 | B2 | 11/2006 | Silguero |
| 7,182,135 | B2 | 2/2007 | Szarka |
| 7,219,724 | B2 | 5/2007 | Theriot, Sr. |
| 7,225,870 | B2 | 6/2007 | Pedersen et al. |
| 7,330,397 | B2 | 2/2008 | Ganesan et al. |
| 7,353,873 | B2 | 4/2008 | Borst et al. |
| 7,533,727 | B2 | 5/2009 | Barton et al. |
| 7,735,547 | B2 | 6/2010 | Telfer |
| 7,748,760 | B2 | 7/2010 | Kushida et al. |
| 7,753,114 | B1 | 7/2010 | Penisson |
| 7,753,124 | B1 | 7/2010 | Penisson |
| 7,766,088 | B2 | 8/2010 | Saucier et al. |
| 8,181,701 | B2 | 5/2012 | Yokley et al. |
| 8,220,532 | B2 | 7/2012 | Hagen |
| 8,327,930 | B2 | 12/2012 | Rondeau |
| 8,353,349 | B2 | 1/2013 | Hern et al. |
| 8,393,401 | B2 | 3/2013 | Yokley et al. |
| 8,534,368 | B2 | 9/2013 | Reimert et al. |
| 8,678,091 | B2 | 3/2014 | Nelson et al. |
| 8,800,660 | B2 | 8/2014 | Fishbeck et al. |
| 8,844,622 | B2 | 9/2014 | Telfer |
| 8,997,858 | B2 | 4/2015 | Tom |
| 9,068,413 | B2 | 6/2015 | Doane |
| 9,068,414 | B2 | 6/2015 | Doane |
| 9,074,437 | B2 | 7/2015 | Stingerie et al. |
| 9,080,404 | B2 | 7/2015 | Kalb et al. |
| 9,121,242 | B2 * | 9/2015 | Leiper ..... E21B 31/06 |
| 9,217,309 | B2 | 12/2015 | Kalb et al. |
| 9,243,492 | B2 | 1/2016 | Fraser |
| 9,260,941 | B2 | 2/2016 | Linklater |
| 9,267,348 | B2 | 2/2016 | Ingram et al. |
| 9,322,235 | B2 | 4/2016 | Turley et al. |
| 9,428,998 | B2 | 8/2016 | Turley et al. |
| 9,518,452 | B2 | 12/2016 | Turley et al. |
| 9,650,854 | B2 | 5/2017 | Devarajan et al. |
| 9,771,793 | B2 | 9/2017 | Fraser et al. |
| 9,816,357 | B2 | 11/2017 | Abraham |
| 9,822,610 | B2 | 11/2017 | Delzell et al. |
| 9,863,217 | B2 | 1/2018 | Cooper |
| 9,863,219 | B2 | 1/2018 | Leiper et al. |
| 9,995,099 | B2 | 6/2018 | Halfmann |
| 10,012,046 | B2 | 7/2018 | Ewing et al. |
| 10,077,634 | B2 | 9/2018 | Perio, Jr. |
| 10,208,553 | B2 | 2/2019 | Sullivan et al. |
| 10,240,417 | B2 | 3/2019 | Stangeland |
| 10,273,780 | B2 | 4/2019 | Garcia et al. |
| 10,301,907 | B2 | 5/2019 | Budde |
| 10,487,627 | B2 | 11/2019 | Leiper et al. |
| 10,895,129 | B2 | 1/2021 | Linklater et al. |
| 11,480,032 | B2 | 10/2022 | Garcia |
| 2008/0257560 | A1 | 10/2008 | Brisco et al. |
| 2009/0211816 | A1 | 8/2009 | Williams |
| 2009/0272544 | A1 | 11/2009 | Giroux et al. |
| 2011/0121145 | A1 * | 5/2011 | Mihajlovic ..... H01F 7/0252 248/188 |
| 2012/0175133 | A1 | 7/2012 | Nikiforuk |
| 2012/0222861 | A1 | 9/2012 | Eriksen |
| 2014/0196912 | A1 | 7/2014 | Turley et al. |
| 2014/0305662 | A1 | 10/2014 | Giroux et al. |
| 2015/0192000 | A1 | 7/2015 | Cooper |
| 2016/0230505 | A1 | 8/2016 | Garcia et al. |
| 2016/0326832 | A1 | 11/2016 | Watson et al. |
| 2018/0223615 | A1 | 8/2018 | Luke et al. |
| 2019/0136668 | A1 | 5/2019 | McMillon et al. |
| 2021/0115746 | A1 | 4/2021 | Atkins |
| 2021/0115757 | A1 | 4/2021 | Murray et al. |

FOREIGN PATENT DOCUMENTS

| | | | |
|---|---|---|---|
| WO | 2006120453 | A1 | 11/2006 |
| WO | 2017065721 | A1 | 4/2017 |
| WO | 2021178126 | A1 | 9/2021 |

OTHER PUBLICATIONS

U.S. Office Action dated May 12, 2021, for U.S. Appl. No. 16/805,941, 7 pages.

U.S. Final Office Action dated Sep. 29, 2021, for U.S. Appl. No. 16/805,941, 7 pages.

International Search Report and Written Opinion dated Apr. 16, 2021 for Application No. PCT/US2021/018122, 10 pages.

* cited by examiner

DEBRIS COLLECTION TOOL

CROSS-REFERENCE TO RELATED APPLICATIONS

This application is a continuation of, and claims benefit from, U.S. patent application Ser. No. 16/883,746, filed May 26, 2020, which is herein incorporated by reference in its entirety.

This application is related to U.S. patent application Ser. No. 16/805,941, filed on Mar. 2, 2020, which is herein incorporated by reference in its entirety.

BACKGROUND

Field

The present invention relates to wellbore tools. More specifically, the invention relates to a debris collection tool utilizing magnets to collect metallic debris in a wellbore.

Description of the Related Art

Many operations in an oil or gas well often produce a variety of debris in the wellbore. For example, milling operations may produce metallic mill cuttings, which may not be completely removed by simple circulation of fluid in the wellbore. Retrieval tools containing magnets have been used to collect magnetic debris in wellbores. Magnetic retrieval tools typically have magnets disposed on the exterior of the tool. Having the magnets continuously attracting metallic objects is problematic because there are times when it is desired for the tool to be non-attractive to debris, such as during run-in. Some tools have electromagnets that can be turned on and off remotely from the surface. These are unreliable and may require a source of power downhole. Additionally, having magnets exposed even when not in use increases the chance of damage and malfunction.

There is a need, therefore, for an improved magnetic debris retrieval tool for retrieving debris from the wellbore.

SUMMARY

The present disclosure generally relates to a debris collection tool that can be used in a wellbore. In one embodiment, a debris collection tool includes a mandrel having a longitudinal flowbore therethrough and an inner sleeve disposed around the mandrel. A first array of magnets is arranged on the inner sleeve. A second array of magnets is disposed around the inner sleeve. The debris collection tool further includes an adaptor sleeve concentric with the mandrel and a linkage coupling the adaptor sleeve with the inner sleeve.

In another embodiment, a debris collection tool includes a mandrel having a longitudinal flowbore therethrough and an inner sleeve disposed around the mandrel. A first array of magnets is arranged on the inner sleeve. The first array of magnets includes a plurality of inner magnets disposed around a circumference of the inner sleeve. The inner sleeve has a longitudinal groove between two adjacent magnets of the first array of magnets. The debris collection tool further includes a second array of magnets disposed around the inner sleeve. The second array of magnets includes an annular arrangement of magnets between a pair of axially spaced end bands and a bridge between two circumferentially adjacent magnets. The bridge is configured to project into the longitudinal groove.

In another embodiment, a magnet assembly includes first and second annular end bands and an annular arrangement of magnets disposed between the first and second annular end bands. The first and second annular end bands include substantially a non-magnetic material. The magnet assembly further includes a plurality of bridges. Each bridge is disposed between the first and second annular end bands and between circumferentially adjacent magnets of the annular arrangement of magnets. The bridges include substantially a magnetic material.

In another embodiment, a controller for a wellbore tool includes a first housing defining a first chamber, and a second housing coupled to the first housing and defining a second chamber. The controller further includes a valve block separating the first and second chambers. A piston is axially movable within the first chamber. A sleeve is coupled to the piston, and extends from the first chamber into the second chamber through the valve block. A fastener is coupled to sleeve and coupled to the second housing. The controller further includes a central longitudinal flowbore through the sleeve and the piston. A first bore through the valve block fluidically couples an annulus between the sleeve and the first housing with the second chamber, and a check valve is associated with the first bore. A second bore through the valve block fluidically couples an annulus between the sleeve and the first housing with the second chamber, and a stop valve is associated with the second bore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure relates to a debris collection tool for retrieving metallic debris from a wellbore. The debris collection tool may have magnets, and may use magnetic fields to attract metallic debris. The debris collection tool may be switched between an inactive configuration, in which the magnetic fields emanating from the debris collection tool are relatively weak, and an activated configuration, in which the magnetic fields emanating from the debris collection tool are relatively strong.

The debris collection tool may include components or materials that are deemed to be "magnetic" or "non-magnetic." A materials that is termed "non-magnetic" has a low relative magnetic permeability, whereas a material that is termed "magnetic" has a high relative magnetic permeability. Magnetic permeability is a measure of the ability of a material to support the formation of magnetic fields. Relative magnetic permeability is the ratio of the magnetic permeability of the particular material to the magnetic permeability of free space (i.e. a vacuum), and is denoted by the equation:

$$\mu_r = \mu/\mu_0$$

where $\mu_r$ is the relative magnetic permeability of the material, $\mu$ is the actual magnetic permeability of the material, and $\mu_0$ is the actual magnetic permeability of free space.

Table 1 provides some example values of relative magnetic permeability for selected materials.

TABLE 1

| Material | Relative Magnetic Permeability ($\mu_r$) |
|---|---|
| Wood | 1.00000043 |
| Aluminum | 1.000022 |
| Nickel | 100-600 |
| 99.8% pure Iron | 5,000 |
| 99.95% pure Iron annealed in Hydrogen | 200,000 |

Table 1 shows that 99.95% pure iron annealed in hydrogen has a higher relative magnetic permeability than 99.8% pure iron, which has a higher relative magnetic permeability than nickel, which has a higher relative magnetic permeability than aluminum and wood. Thus, as used herein, the terms "magnetic" and "non-magnetic" may be considered as relative terms.

Figure 1:
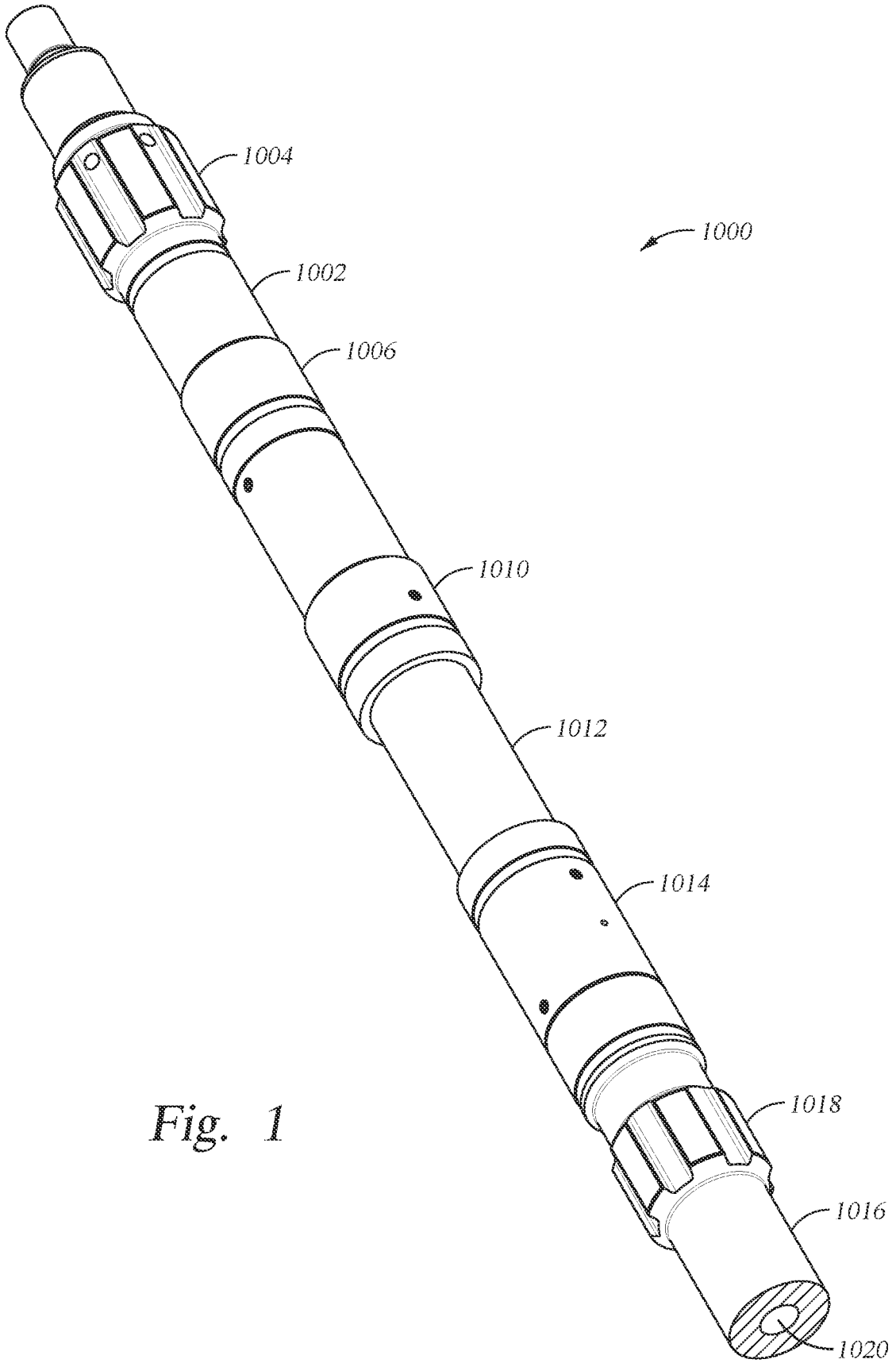
FIG. 1 is a perspective view of an embodiment of a debris collection tool.

FIG. 1 is a perspective view of a debris collection tool 1000. The debris collection tool 1000 may include an upper housing 1002. The upper housing 1002 may have an upper centralizer 1004. In some embodiments, the upper centralizer 1004 may move axially and/or rotationally relative to the upper housing 1002. In some embodiments, the upper centralizer 1004 may not move axially or rotationally relative to the upper housing 1002. In some embodiments, the upper centralizer 1004 and the upper housing 1002 have a unitary construction. The upper housing 1002 may be coupled to a bulkhead 1006 of a mandrel 1008 (see FIG. 2). The bulkhead 1006 may be coupled to an upper bonnet 1010, which may be coupled to a cover 1012. The cover 1012 may be coupled to a lower bonnet 1014, which may be coupled to a lower housing 1016. The lower housing 1016 may have a lower centralizer 1018. In some embodiments, the lower centralizer 1018 may move axially and/or rotationally relative to the lower housing 1016. In some embodiments, the lower centralizer 1018 may not move axially nor rotationally relative to the lower housing 1016. In some embodiments, the lower centralizer 1018 and the lower housing 1016 have a unitary construction.

In some embodiments the upper housing 1002 may be omitted. In some embodiments the upper centralizer 1004 may be omitted. In some embodiments the lower housing 1016 may be omitted. In some embodiments, the lower centralizer 1018 may be omitted. The debris collection tool 1000 may be configured to be connected to other tools and/or a workstring at the bulkhead 1006 or, if present, the upper housing 1002. The debris collection tool 1000 may have a central longitudinal flowbore 1020 that continues from an upper end of the upper housing 1002, through the mandrel 1008, and down to a lower end of the lower housing 1016. The debris collection tool 1000 may be configured to be connected to other tools and/or a workstring at the lower bonnet 1014 or, if present, the lower housing 1016.

Figure 2:
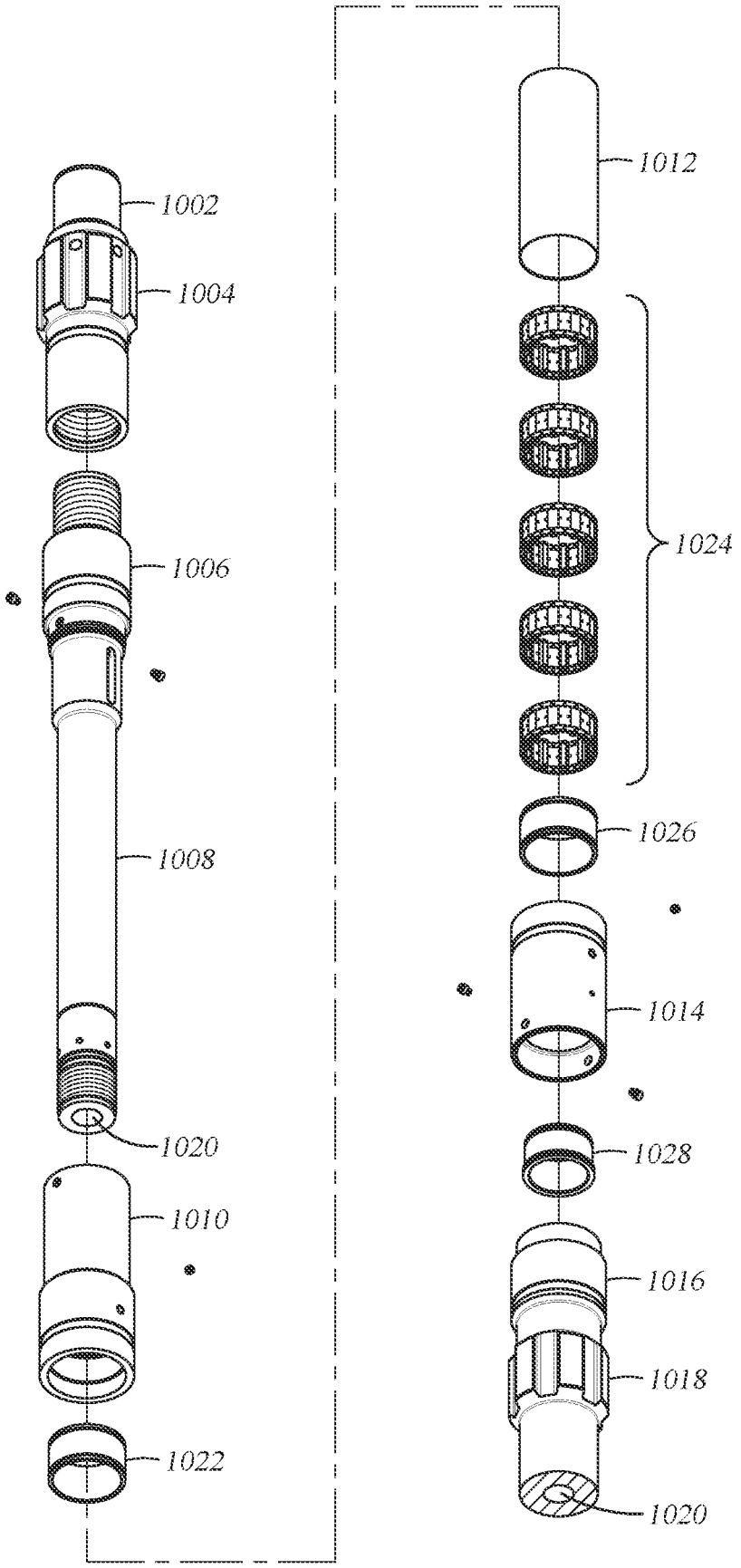
FIG. 2 is an exploded view of some components of an embodiment of a debris collection tool.
Figure 4:
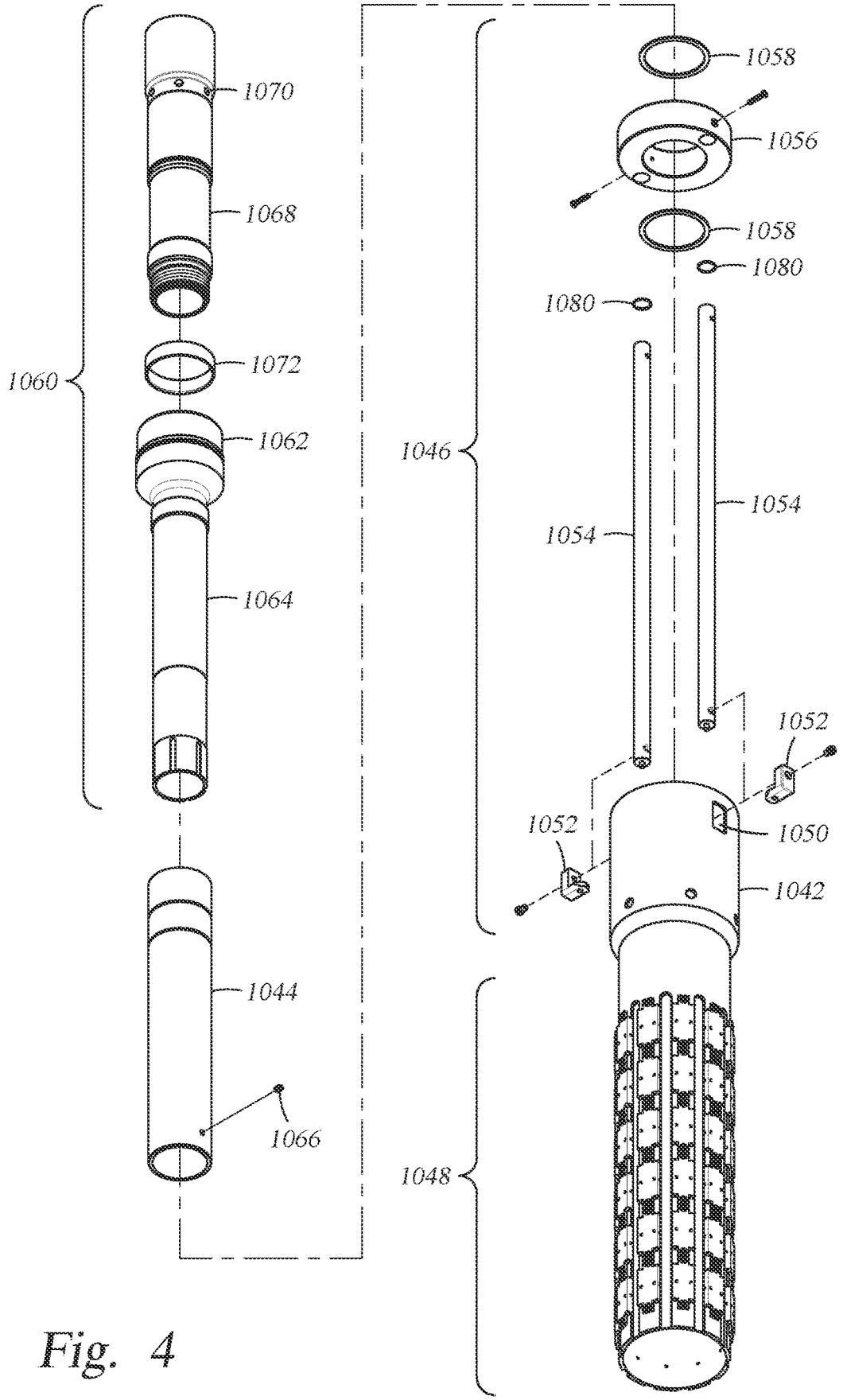
FIG. 4 is an exploded view of some components of an embodiment of a debris collection tool.

FIG. 2 is an exploded view of some components of the debris collection tool 1000. FIG. 4 is an exploded view of some additional components of the debris collection tool 1000. As shown in FIG. 2, a mandrel 1008 may include the bulkhead 1006. In some embodiments, the bulkhead 1006 and the mandrel 1008 may be formed as a unitary component. In some embodiments, the bulkhead 1006 and the mandrel 1008 may include multiple parts that are coupled together. The upper bonnet 1010 may encircle the mandrel 1008 in order to be coupled to the bulkhead 1006. An upper shield 1022 may encircle the mandrel 1008 and be coupled to an interior portion of the upper bonnet 1010. A cover 1012 may encircle the mandrel 1008 and be coupled to an interior portion of the upper bonnet 1010. An outer magnet array 1024 may encircle the mandrel 1008 and inside the cover 1012. The lower bonnet 1014 may encircle the mandrel 1008 and be coupled to a lower end of the cover 1012. A lower shield 1026 may encircle the mandrel 1008 and be coupled to an interior portion of the lower bonnet 1014. A floating piston 1028 may encircle the mandrel 1008 and be coupled to an interior portion of the lower bonnet 1014.

Figure 3:
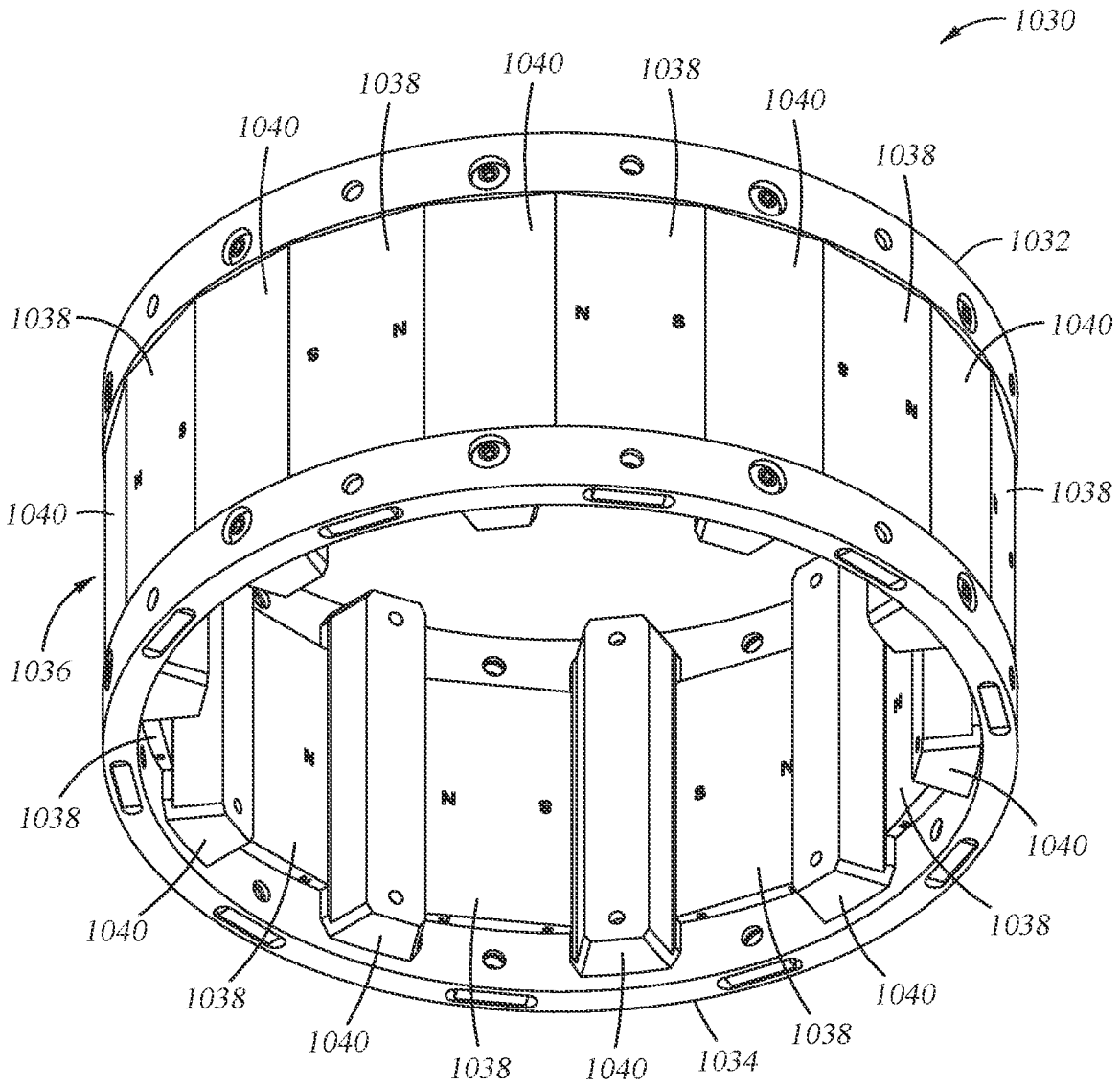
FIG. 3 is a perspective view of one of the components of FIG. 2.

FIG. 3 provides a perspective view of an outer magnet assembly 1030 that forms part of the outer magnet array 1024. The outer magnet array 1024 may include one or more outer magnet assembly 1030. The outer magnet assembly 1030 may include an upper end band 1032 and a lower end band 1034. The upper end band 1032 and the lower end band 1034 may be annular in shape. In some embodiments, the upper end band 1032 and the lower end band 1034 may be made out of a substantially non-magnetic material. A ring 1036 of outer magnets 1038 may be disposed between the upper end band 1032 and the lower end band 1034 such that each outer magnet 1038 is coupled to the upper end band 1032 and the lower end band 1034. The outer magnets 1038 may be arranged in the ring 1036 such that the poles of each outer magnet 1038 are circumferentially aligned. The outer magnets 1038 may be arranged to form the ring 1036 such that the North pole of one outer magnet 1038 is facing the North pole of a neighboring outer magnet 1038. Similarly, the South pole of one outer magnet 1038 may be facing the South pole of another neighboring outer magnet 1038.

Each pair of circumferentially adjacent outer magnets 1038 of a ring 1036 of outer magnets 1038 may be separated by a bridge 1040. Each outer magnet 1038 may be circumferentially adjacent to a bridge 1040 at the outer magnet's 1038 North pole and another bridge 1040 at the outer magnet's 1038 South pole. Hence the ring 1036 of outer magnets 1038 may include a circumferentially aligned sequence of components in which the components form an alternating sequence of outer magnet 1038, bridge 1040, outer magnet 1038, bridge 1040, and so on. Each bridge 1040 may be formed from a magnetic material, such as a grade of steel that has a relatively high relative magnetic permeability. In some embodiments, one or more bridge 1040 may be sized to extend radially inwardly of the ring 1036 of outer magnets 1038.

Successive rings 1036 of outer magnets 1038 may be axially aligned to form the outer magnet array 1024. Each outer magnet 1038 within a ring 1036 of outer magnets 1038 may be axially aligned with a corresponding outer magnet 1038 of an adjacent ring 1036 of outer magnets 1038. Hence, the outer magnets 1038 may be aligned in rows in addition to being aligned circumferentially. Additionally, each bridge 1040 within a ring 1036 of outer magnets 1038 may be axially aligned with a corresponding bridge 1040 of an adjacent ring 1036 of outer magnets 1038. Hence, the bridges 1040 may be aligned in rows in addition to being aligned circumferentially.

Each outer magnet 1038 may include a magnetic material. Some example magnetic materials may include, without limitation, ceramic ferrite, neodymium iron boron, samarium cobalt, and aluminum nickel cobalt. The magnetic material may be encased in a non-magnetic material, such as stainless steel, for the physical and chemical protection of the magnetic material.

Figure 5:
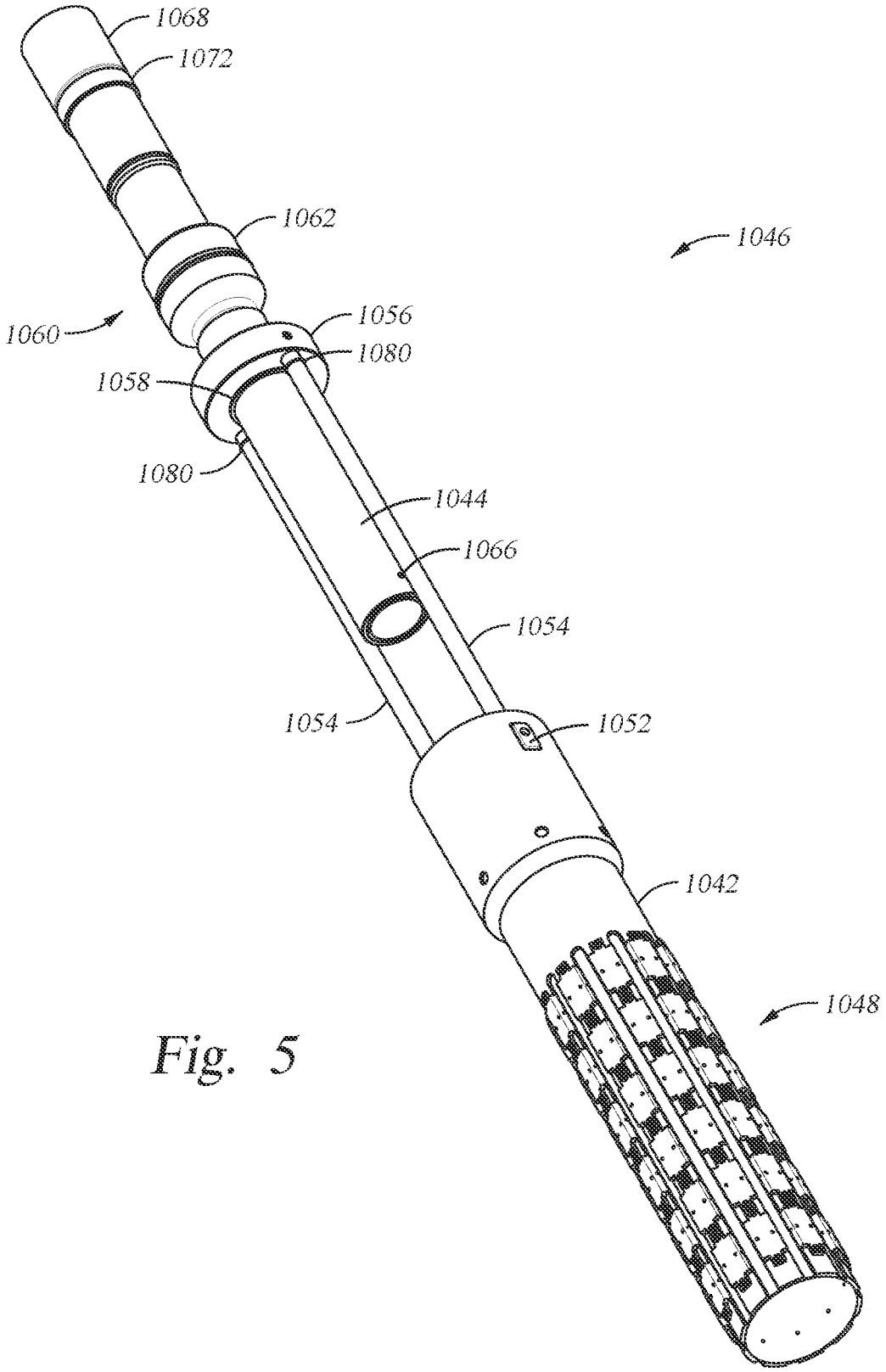
FIG. 5 is a perspective view of the components of FIG. 4 in an assembled configuration.

FIG. 4 is an exploded view of some components of the debris collection tool 1000 that are additional to the components shown in FIG. 2. FIG. 5 is a perspective view of the components of FIG. 4 as assembled according to one embodiment. The debris collection tool 1000 may have an inner sleeve 1042 coupled to an adaptor sleeve 1044 by a linkage 1046. The inner sleeve 1042 may encircle the mandrel 1008, and may have an inner magnet array 1048. The inner magnet array 1048 may be mounted on an outer surface of the inner sleeve 1042. The inner sleeve 1042 may have one or more aperture 1050 that is sized to accept a key 1052 of the linkage 1046. The linkage 1046 may include one or more key 1052, and each key 1052 may be coupled to an elongate member 1054, such as a rod, a strip, a wire, or a tube. The elongate member 1054 may be coupled to a yoke 1056. In some embodiments, one end of the elongate member 1054 may be coupled to a key 1052 and the other end of the elongate member 1054 may be coupled to the yoke 1056. In some embodiments that include multiple elongate members 1054, the multiple elongate members 1054 may be coupled to a single yoke 1056. In some embodiments, the yoke 1056 may be a unitary member. In some embodiments, the yoke 1056 may include multiple parts coupled together. The yoke 1056 may be coupled to an outer surface of the adaptor sleeve 1044. In some embodiments, the coupling between the yoke 1056 and the adaptor sleeve 1044 may include one or more fastener 1058, such as a set screw, a snap ring, a latch, a locking dog, etc. Because of the one or more fastener 1058, the yoke 1056 may have limited scope for axial movement relative to the adaptor sleeve 1044. In some embodiments, the yoke 1056 may be coupled to the adaptor sleeve 1044 such that the yoke 1056 and the adaptor sleeve 1044 may rotate independently of, and relative to, one another.

In some embodiments, the adaptor sleeve 1044 may be coupled to an adaptor assembly 1060. In some embodiments, the adaptor assembly 1060 may be omitted. In some embodiments, the adaptor assembly 1060 may be configured to couple the adaptor sleeve 1044 to a tool positioned close to the debris collection tool 1000. The tool positioned close to the debris collection tool 1000 may be a controller, such as any of the controllers 1106 depicted in FIGS. 13 and 14. In some embodiments, a tool, such as a controller, may be positioned close to the debris collection tool 1000, and may be coupled to the adaptor sleeve 1044 without an intermediate adaptor assembly 1060. In some embodiments, the adaptor assembly 1060 may include a single component. In some embodiments, the adaptor assembly 1060 may include multiple components.

As illustrated in FIG. 4, the adaptor assembly 1060 may include an adaptor piston 1062 having an adaptor skirt 1064. The adaptor skirt 1064 may be generally cylindrical, and may be sized to fit inside the adaptor sleeve 1044. The adaptor sleeve 1044 may be coupled to the adaptor skirt 1064, and retained in position using a fastener 1066, such as a set screw, a snap ring, a latch, a locking dog, etc. In some embodiments, a longitudinal position of the adaptor sleeve 1044 on the adaptor skirt 1064 may be adjusted. In some embodiments, the longitudinal position of the adaptor sleeve 1044 on the adaptor skirt 1064 may be adjusted by merely sliding the adaptor sleeve 1044 to a desired position. In some embodiments, the longitudinal position of the adaptor sleeve 1044 on the adaptor skirt 1064 may be adjusted by altering a threaded engagement between the adaptor sleeve 1044 and the adaptor skirt 1064. In some embodiments, the adaptor assembly 1060 may include an adaptor extension 1068 coupled to the adaptor piston 1062. The adaptor extension 1068 may include one or more port 1070. The adaptor extension 1068 may include a debris filter 1072 associated with the one or more port 1070.

Figure 6:
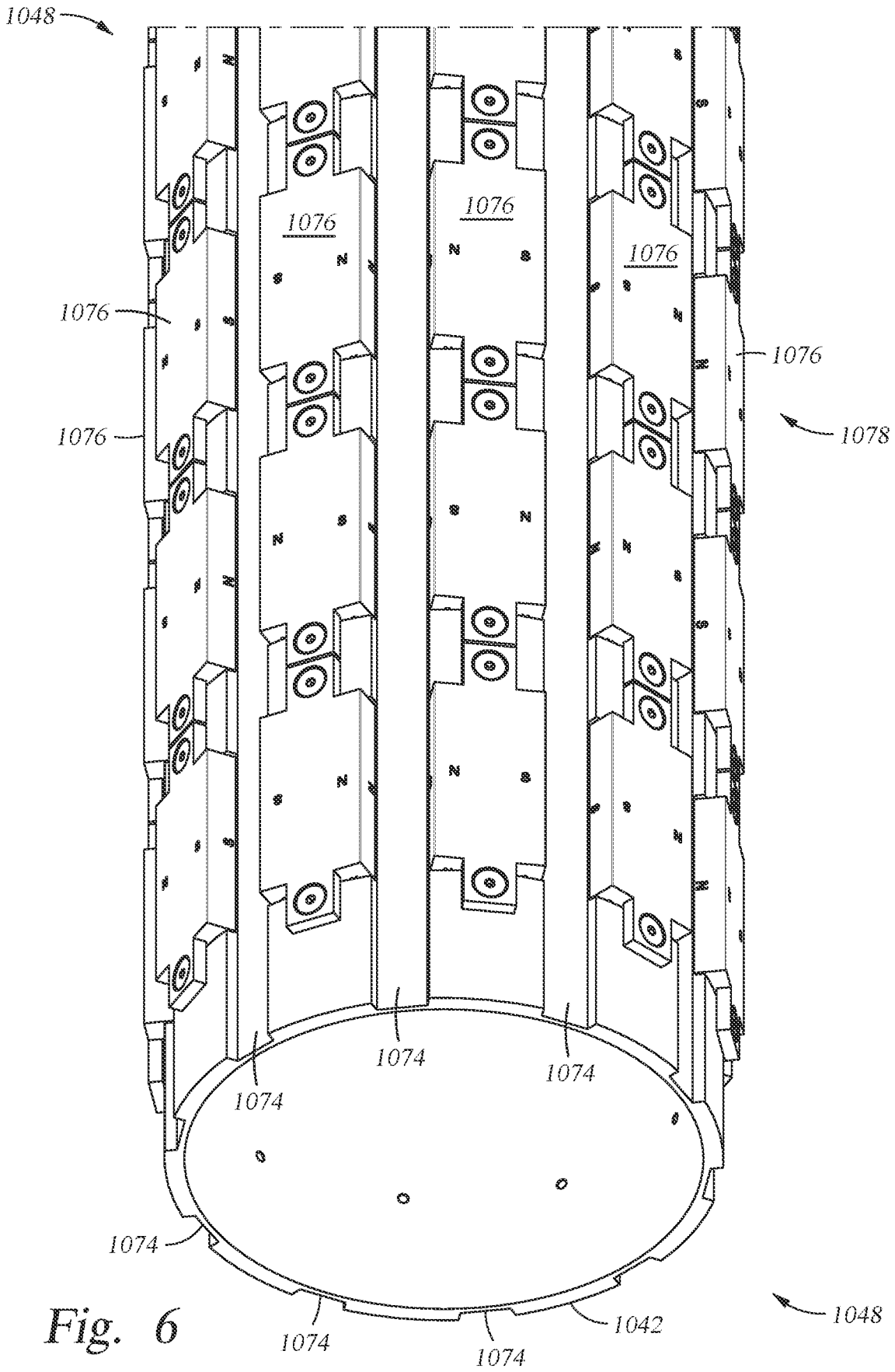
FIG. 6 is a perspective view of one of the components of FIG. 4.

FIG. 6 is a perspective view of a portion of the inner magnet array 1048 mounted on an outer surface of the inner sleeve 1042. The inner sleeve 1042 may be generally cylindrical and having inner and outer surfaces. The outer surface may have one or more longitudinal groove 1074. An array 1048 of inner magnets 1076 may be disposed on the outer surface of the inner sleeve 1042. The inner magnets 1076 may be arranged such that the inner magnets 1076 may be axially aligned in rows. The inner magnets 1076 may be arranged such that the inner magnets 1076 may be circumferentially aligned. Thus, each group of circumferentially aligned inner magnets 1076 forms a ring 1078 of inner magnets 1076. The inner magnets 1076 may be arranged such that each pair of circumferentially adjacent inner magnets 1076 may be separated by a longitudinal groove 1074. In embodiments in which the inner magnets 1076 are axially aligned and circumferentially aligned, the inner magnets 1076 may be arranged into axially aligned rings of inner magnets 1076. For reference with later figures, the ring 1078 of inner magnets 1076 closest to a lower end of the inner sleeve 1042 may be considered as a first ring 1078 of inner magnets 1076. Similarly, the ring 1078 of inner magnets 1076 next to the first ring 1078 of inner magnets 1076 may be considered as a second ring 1078 of inner magnets 1076.

The inner magnets 1076 may be arranged such that the poles of each inner magnet 1076 are aligned with a circumference of the corresponding ring 1078 of inner magnets 1076 to which each magnet belongs. The inner magnets 1076 may be arranged within each ring 1078 such that the North pole of one inner magnet 1076 is facing the North pole of a neighboring inner magnet 1076. Similarly, the South pole of one inner magnet 1076 may be facing the South pole of another neighboring inner magnet 1076.

Each inner magnet 1076 may include a magnetic material. Some example magnetic materials may include, without limitation, ceramic ferrite, neodymium iron boron, samarium cobalt, and aluminum nickel cobalt. The magnetic material may be encased in a non-magnetic material, such as stainless steel, for the physical and chemical protection of the magnetic material.

Figure 7A:
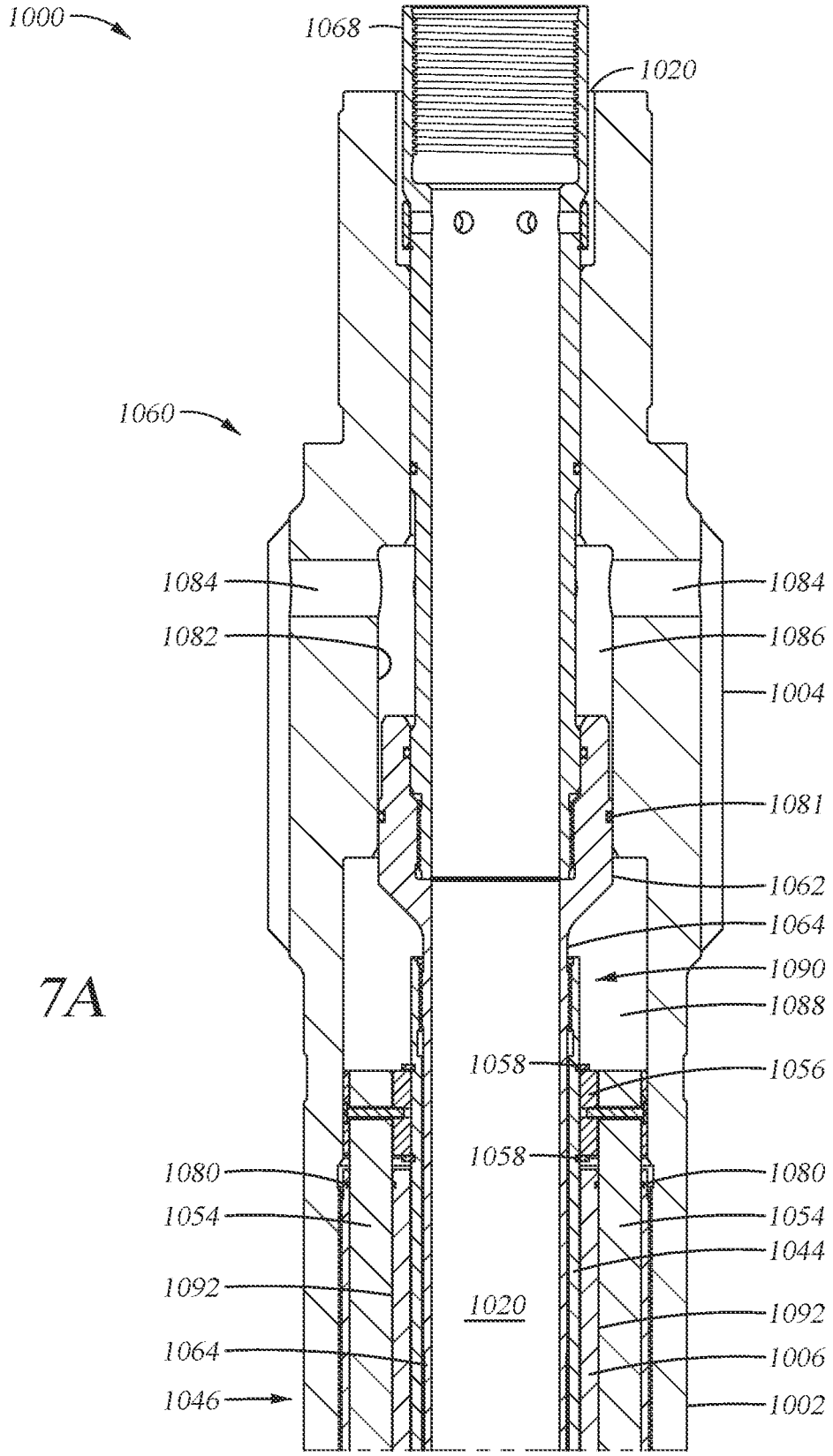
FIGS. 7A to 7D present a longitudinal cross-section of an embodiment of a debris collection tool in an inactive condition.
Figure 7B:
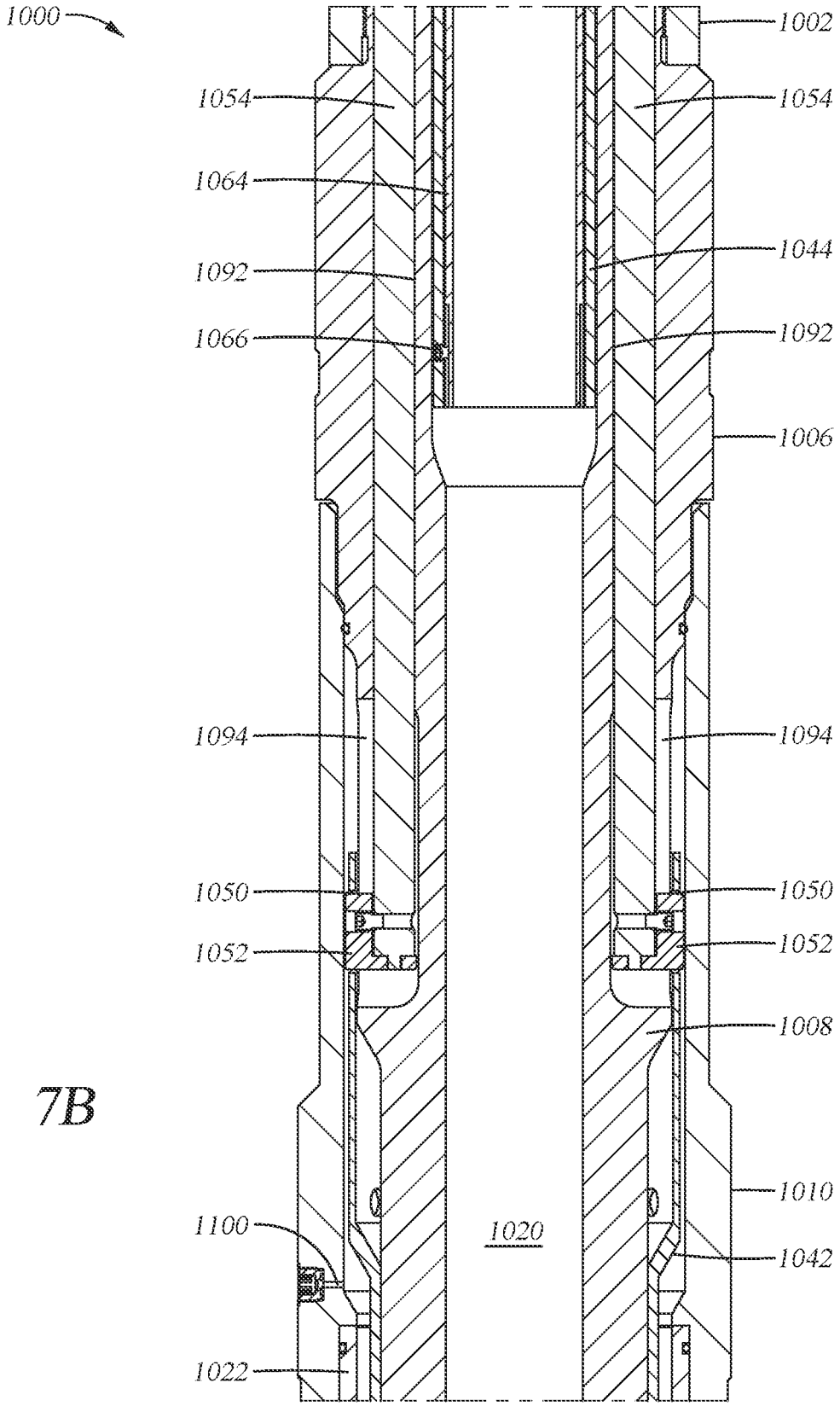

FIGS. 7A to 7D provide a longitudinal cross-sectional view of an embodiment of the debris collection tool 1000 as assembled in the inactive configuration. As shown in FIGS. 7A and 7B, an upper housing 1002 may have an upper centralizer 1004, and may be coupled to a bulkhead 1006 of a mandrel 1008. An adaptor assembly 1060 may be disposed inside central longitudinal flowbore 1020 of the debris collection tool 1000 through the upper housing 1002 and the mandrel 1008. The adaptor assembly 1060 may include an adaptor extension 1068 coupled to an adaptor piston 1062. The adaptor piston 1062 may be coupled to an adaptor skirt 1064. In some embodiments, the adaptor piston 1062 and the adaptor skirt 1064 may be formed as a unitary component. In some embodiments, the adaptor extension 1068 and the adaptor piston 1062 may be formed as a unitary component. In some embodiments, the adaptor extension 1068, adaptor piston 1062, and the adaptor skirt 1064 together may be formed as a unitary component.

The adaptor piston 1062 may have one or more seal 1081 that contacts an inner wall 1082 of the upper housing 1002. The upper housing 1002 and/or the upper centralizer 1004 may have one or more port 1084 that fluidically couples an interior portion 1086 of the upper housing 1002 with an exterior of the upper housing 1002. The adaptor piston 1062 may be positioned below the port 1084. Thus, the adaptor piston 1062 may separate the interior portion 1086 of the upper housing that has a direct fluidic connection with an exterior of the upper housing 1002 from an activation chamber 1088 that does not have a direct fluidic connection with an exterior of the upper housing 1002.

Still with FIGS. 7A and 7B, in FIG. 7A an adaptor sleeve 1044 is shown coupled to the adaptor skirt 1064 of the adaptor assembly 1060 by a threaded connection 1090 that allows for adjustment of the relative axial positioning of the adaptor sleeve 1044 and the adaptor skirt 1064. A fastener 1066 that secures the adaptor sleeve 1044 to the adaptor skirt 1064 after adjustment of their relative axial position is shown in FIG. 7B. The adaptor sleeve 1044 and adaptor skirt 1064 may extend into the central longitudinal flowbore 1020 of the debris collection tool 1000 at the bulkhead 1006 of the mandrel 1008.

A yoke 1056 of a linkage 1046 assembly is shown coupled to the adaptor sleeve 1044, and situated in the activation chamber 1088 of the upper housing 1002. In some embodiments, as shown in FIG. 7A, the yoke 1056 may be retained by one or more fastener 1058. The yoke 1056 is shown coupled to elongate members 1054 that extend through secondary bores 1092 of the bulkhead 1006. One or more seals 1080 between each elongate member 1054 and each corresponding secondary bore 1092 inhibits fluid communication through the secondary bores 1092 into, and out of, the activation chamber 1088. As shown in FIG. 7B, each elongate member 1054 is coupled to a key 1052 located in a slot 1094 formed in the mandrel 1008. Each key 1052 is shown coupled to an inner sleeve 1042 by projecting into an aperture 1050.

In FIG. 7B, an upper bonnet 1010 is shown coupled to the bulkhead 1006 and extending over the slots 1094 of the mandrel 1008 and an upper portion of the inner sleeve 1042. The upper bonnet 1010 may be constructed out of a non-magnetic material, such as a stainless steel. Transitioning from FIG. 7B to FIG. 7C, an upper shield 1022 is shown within a lower portion of the upper bonnet 1010. In some embodiments, the upper shield 1022 may be omitted. When present, the upper shield 1022 may be constructed out of a magnetic material, such as a magnetic grade of steel. In some embodiments, the upper shield 1022 may be sized to have a length corresponding to a length of a ring 1078 of inner magnets 1076. In some embodiments, the upper shield 1022 may be sized to have a length that is greater than a length of a ring 1078 of inner magnets 1076. An annular gap between an inner surface of the upper shield 1022 and an outer surface of the inner sleeve 1042 may be sized such that the annular gap may accommodate a ring 1078 of inner magnets 1076. When a ring 1078 of inner magnets 1076 is radially aligned with the upper shield 1022, the upper shield 1022 may inhibit the transmission of a magnetic field from the ring 1078 of inner magnets 1076 through the upper bonnet 1010. Thus, magnetic debris will not be prone to accumulate around the upper bonnet 1010, thereby mitigating a risk of the debris collection tool 1000 becoming stuck in a wellbore due to debris accumulation around the upper bonnet 1010.

Figure 7C:
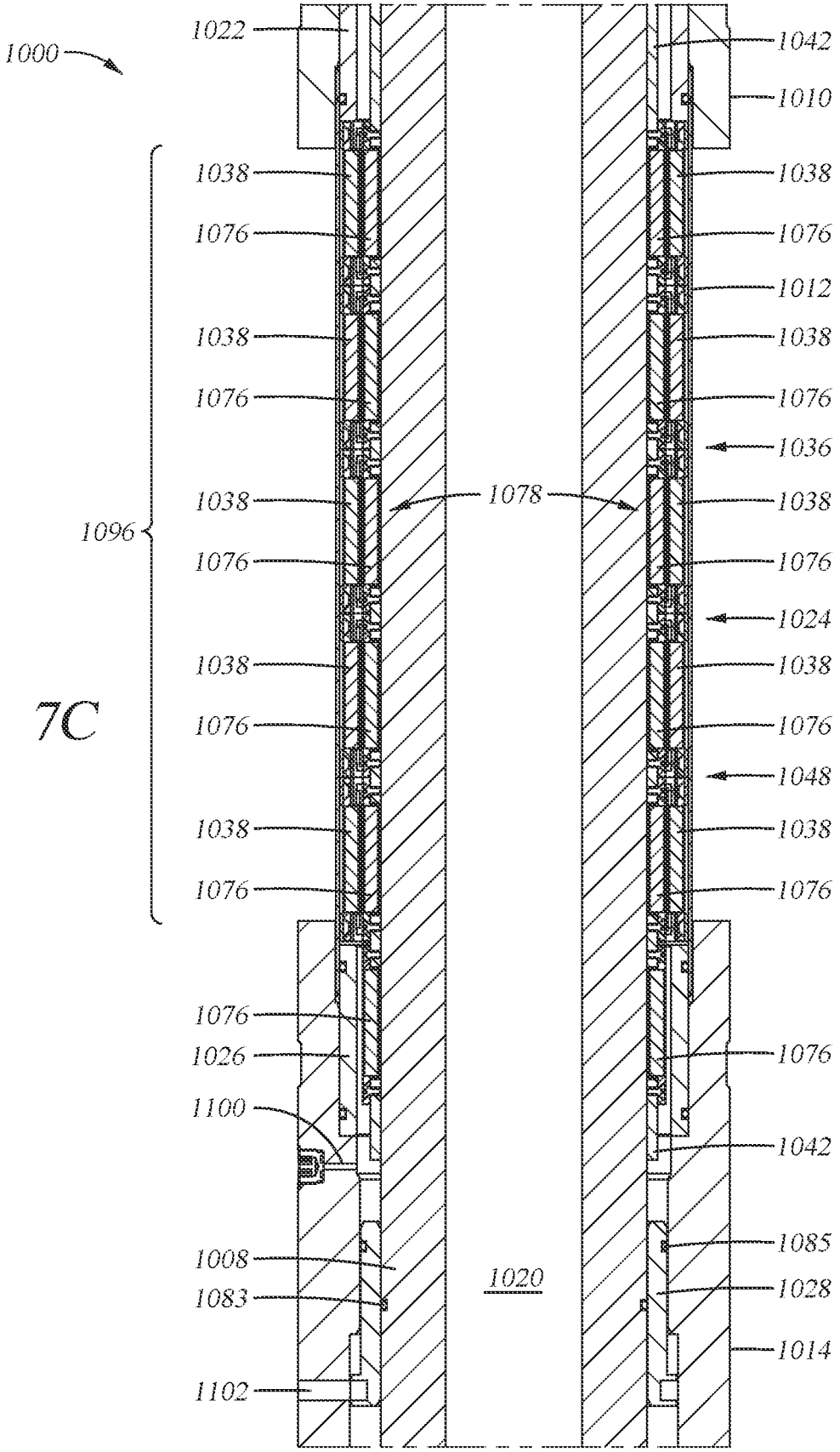
Figure 7D:
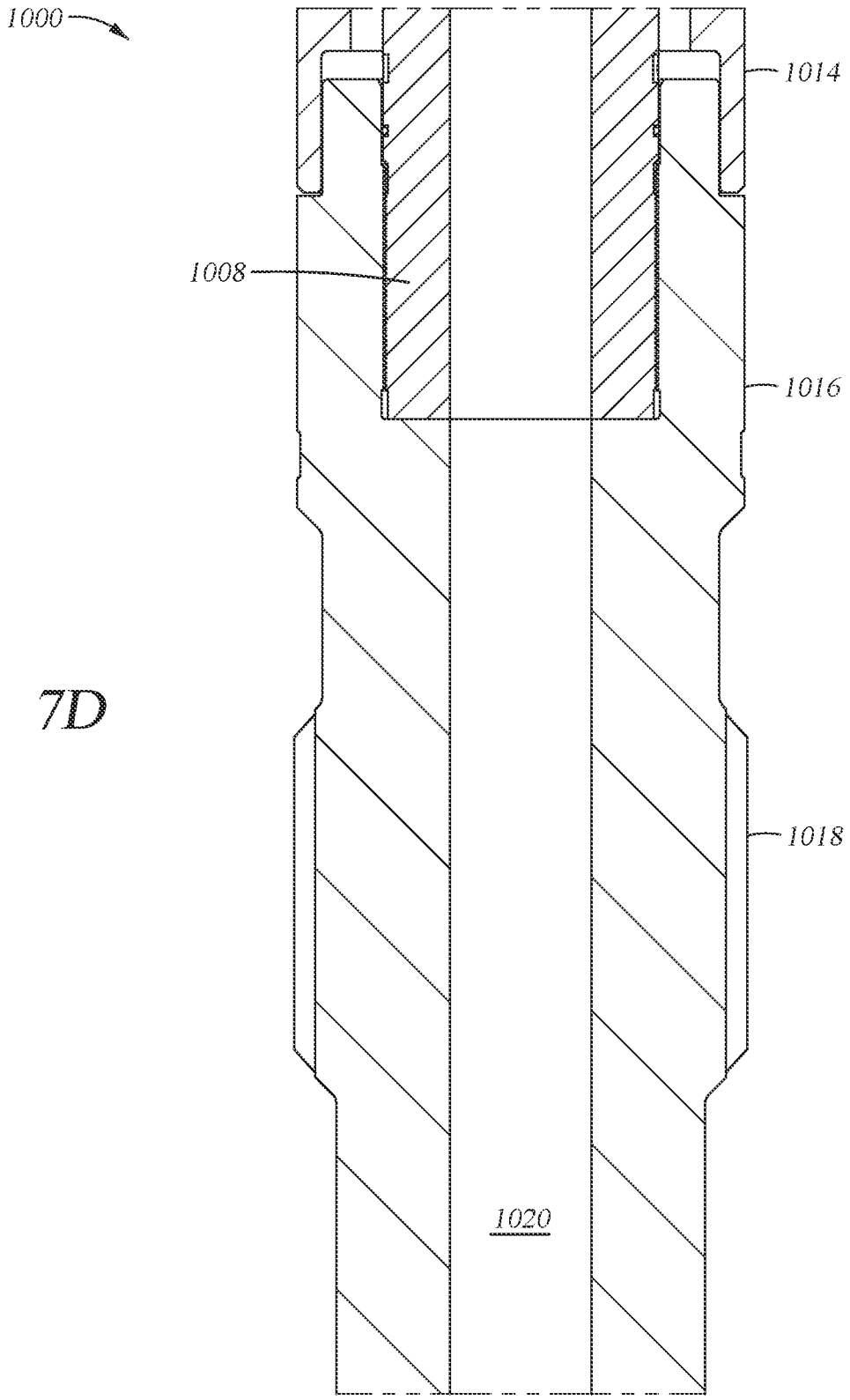

As shown in FIG. 7C, a cover 1012 extends from the upper bonnet 1010 to a lower bonnet 1014. The cover 1012 may be constructed out of a non-magnetic material, such as a stainless steel. In some embodiments, an outer diameter of the cover 1012 may be less than an outer diameter of the upper bonnet 1010 and less than an outer diameter of the lower bonnet 1014. A lower end of the upper bonnet 1010, an upper end of the lower bonnet 1014, and the cover 1012 may define a debris collection zone 1096. The debris collection zone 1096 may thus be recessed with respect to the upper bonnet 1010 and the lower bonnet 1014. Such recessing of the debris collection zone 1096 enables debris to be accumulated on the cover 1012 and mitigates a risk of the debris being washed off due to fluid flow around the exterior of the debris collection tool 1000. Such recessing of the debris collection zone 1096 also mitigates a risk of the debris collection tool 1000 becoming stuck in a wellbore due to debris accumulation around the cover 1012.

The lower bonnet 1014 may be constructed out of a non-magnetic material, such as a stainless steel. A lower shield 1026 is shown within an upper portion of the lower bonnet 1014. In some embodiments, the lower shield 1026 may be omitted. When present, the lower shield 1026 may be constructed out of a magnetic material, such as a magnetic grade of steel. In some embodiments, the lower shield 1026 may be sized to have a length corresponding to a length of a ring 1078 of inner magnets 1076. In some embodiments, the lower shield 1026 may be sized to have a length that is greater than a length of a ring 1078 of inner magnets 1076. An annular gap between an inner surface of the lower shield 1026 and an outer surface of the inner sleeve 1042 may be sized such that the annular gap may accommodate a ring 1078 of inner magnets 1076. When a ring 1078 of inner magnets 1076 is radially aligned with the lower shield 1026, the lower shield 1026 may inhibit the transmission of a magnetic field from the ring 1078 of inner magnets 1076 through the lower bonnet 1014. Thus, magnetic debris will not be prone to accumulate around the lower bonnet 1014, thereby mitigating a risk of the debris collection tool 1000 becoming stuck in a wellbore due to debris accumulation around the lower bonnet 1014.

As shown in FIG. 7C, within the cover 1012, and extending from the upper bonnet 1010 to the lower bonnet 1014 there may be an outer magnet array 1024 having one or more ring 1036 of outer magnets 1038. In embodiments in which the outer magnet array 1024 includes more than one ring 1036 of outer magnets 1038, the rings 1036 of outer magnets 1038 may be longitudinally stacked between the upper bonnet 1010 and the lower bonnet 1014. The ring 1036 of outer magnets 1038 adjacent to the lower shield 1026 may be considered as a first ring 1036 of outer magnets 1038. Similarly, the ring 1036 of outer magnets 1038 next to the first ring 1036 of outer magnets 1038 may be considered as a second ring 1036 of outer magnets 1038. FIG. 7C illustrates the inner sleeve 1042 extending over the mandrel 1008, through the cover 1012 and the outer magnet array 1024, and into an upper portion of the lower bonnet 1014. An inner magnet array 1048 on the inner sleeve 1042 is shown positioned within the outer magnet array 1024.

In some embodiments, a first ring 1078 of inner magnets 1076 may be positioned within the lower shield 1026. In some embodiments, the inner magnet array 1048 may have one ring 1078 of inner magnets 1076 additional to the number of rings 1036 of outer magnets 1038 of the outer magnet array 1024. Hence, a debris collection tool 1000 may include n rings 1036 of outer magnets 1038 and n+1 rings 1078 of inner magnets 1076. In some embodiments, each outer magnet 1038 of the outer magnet array 1024 may be adjacent to, and radially aligned with, a corresponding inner magnet 1076 of the inner magnet array 1048. Thus, each outer magnet 1038 of a first ring 1036 of outer magnets 1038 may be radially adjacent to a corresponding inner magnet 1076 of a second ring 1078 of inner magnets 1076, and so on, such that each outer magnet 1038 of the last ($n^{th}$) ring 1036 of outer magnets 1038 may be radially adjacent to a corresponding inner magnet 1076 of the last ($n+1^{th}$) ring 1078 of inner magnets 1076.

Figure 7E:
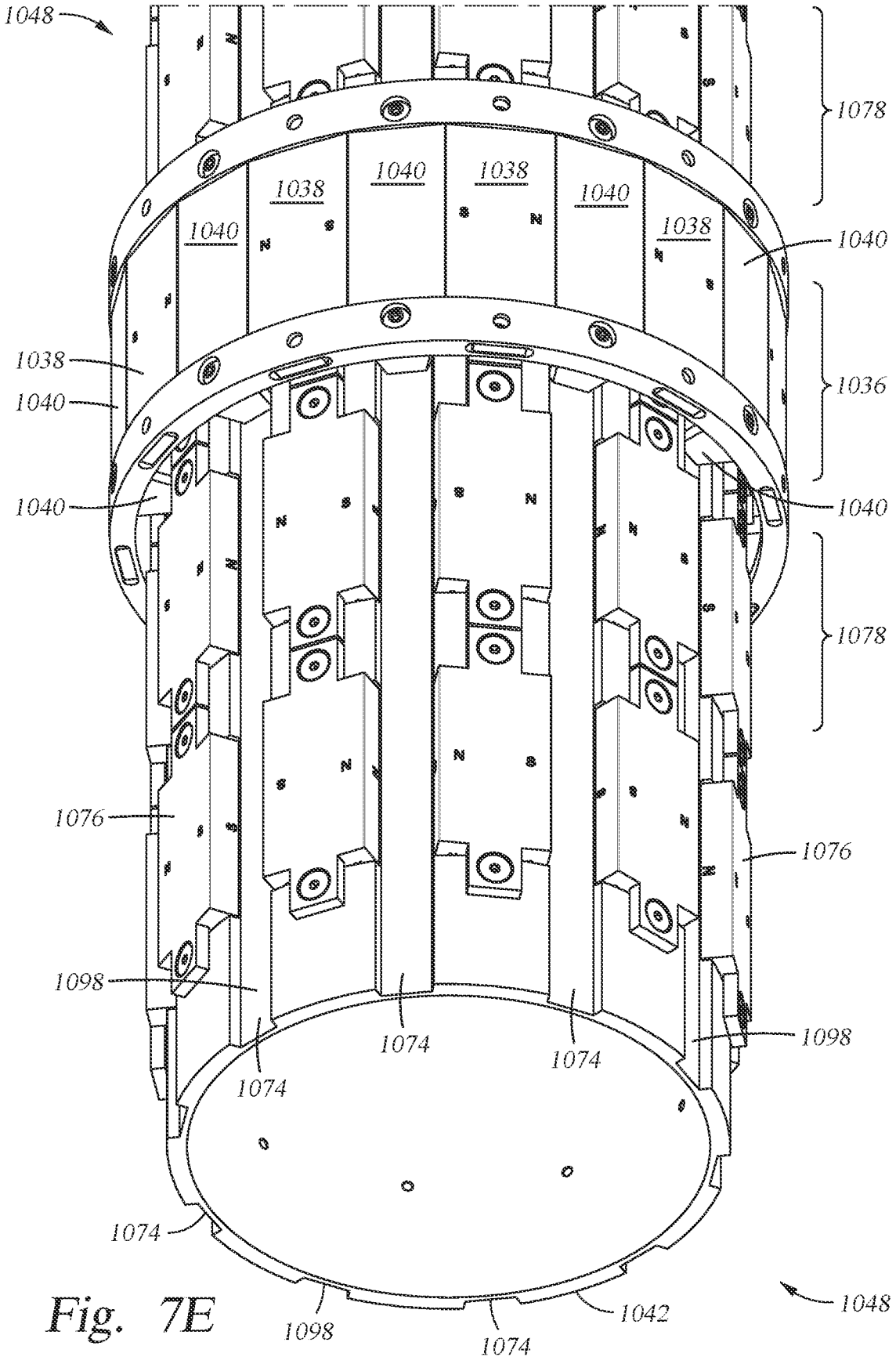
FIG. 7E is a perspective view showing two components of an embodiment of a debris collection tool.

FIG. 7E shows a cut-away perspective view of a ring 1036 of outer magnets 1038 positioned over a ring 1078 of inner magnets 1076. For clarity, only a single ring 1036 of outer magnets 1038 is depicted. Each outer magnet 1038 may be radially adjacent to, and radially aligned with, a corresponding inner magnet 1076. In some embodiments, as illustrated, a radially inward portion of each bridge 1040 of the ring 1036 of outer magnets 1038 may be located in a corresponding longitudinal groove 1074 of the inner sleeve 1042. Therefore, as the inner sleeve 1042 and inner magnet array 1048 moves axially with respect to the outer magnet array 1024, the interaction between each bridge 1040 and the corresponding longitudinal groove 1074 maintains the alignment between individual rows of inner magnets 1076 and corresponding individual rows of outer magnets 1038. In some embodiments, the interaction between each bridge 1040 and a floor 1098 of each corresponding longitudinal groove 1074 may maintain a separation between each outer magnet 1038 and each corresponding radially adjacent inner magnet 1076.

Returning to FIG. 7C, the mandrel 1008 extends through the upper bonnet 1010, through the inner sleeve 1042, and through the lower bonnet 1014. A floating piston 1028 may be contained within an annular space between the lower bonnet 1014 and the mandrel 1008. Seals 1083, 1085 may inhibit the passage of fluid past the floating piston 1028. A sealed compartment may be defined by the annular space between an outer surface of the mandrel 1008 and the inner surfaces of the upper housing 1002, the upper bonnet 1010, the cover 1012, and the lower bonnet 1014; the sealed compartment being bounded at an upper end by the seals 1080 between the elongate members 1054 and the secondary bores of the bulkhead 1006, and at a lower end by the floating piston 1028. The sealed compartment may contain a clean fluid, such as a hydraulic oil, so as to facilitate the movement of the inner sleeve 1042 during operation. During assembly of the debris collection tool 1000, the clean fluid may be introduced into the sealed compartment through one or more filling port 1100 in the upper bonnet 1010 and/or the lower bonnet 1014. Additionally, a filling port 1100 may be use to evacuate air from the sealed compartment while the clean fluid is introduced into the sealed compartment through another filling port 1100.

The annular space between the lower bonnet 1014 and the mandrel 1008 may be exposed to a pressure external to the debris collection tool 1000 through port 1102. The floating piston 1028 may move within the annular space between the lower bonnet 1014 and the mandrel 1008 in order to balance a pressure within the sealed compartment with a pressure external to the debris collection tool 1000. Further, in FIG. 7D, the lower bonnet 1014 may be coupled to a lower housing 1016. The mandrel 1008 may be coupled to the lower housing 1016. The lower housing 1016 may have a lower centralizer 1018.

FIGS. 8A to 8D show the debris collection tool 1000 of FIGS. 7A to 7D in the activated configuration. The debris collection tool 1000 may be switched from the inactive to the activated configurations by the application of pressure in the central longitudinal flowbore 1020 below any present adaptor assembly 1060. This may be achieved, for example, by applying pump pressure to a fluid within a workstring to which the debris collection tool 1000 may be coupled.

Figure 8A:
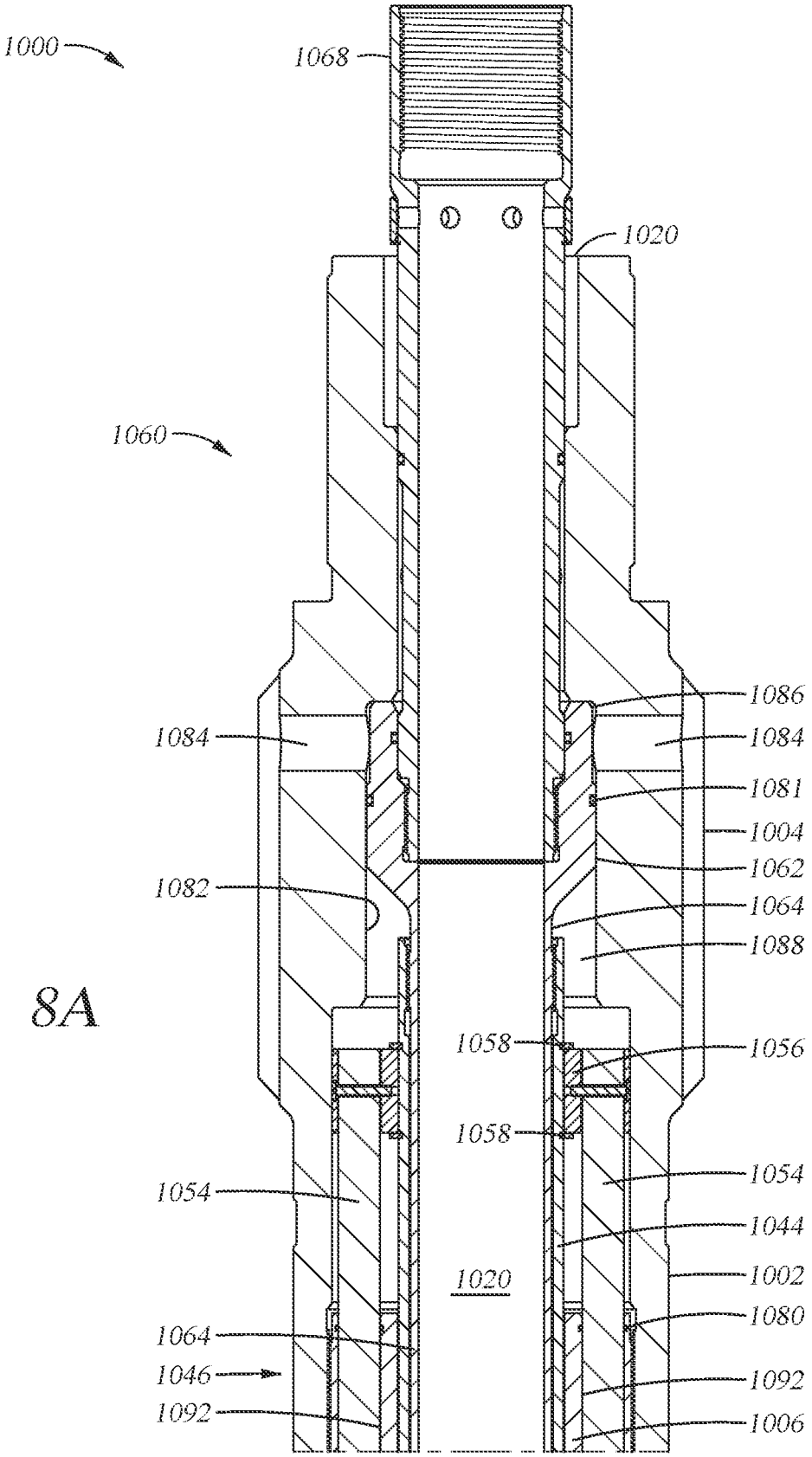
FIGS. 8A to 8D present a longitudinal cross-section of the embodiment of FIGS. 7A to 7D in an activated configuration.
Figure 8B:
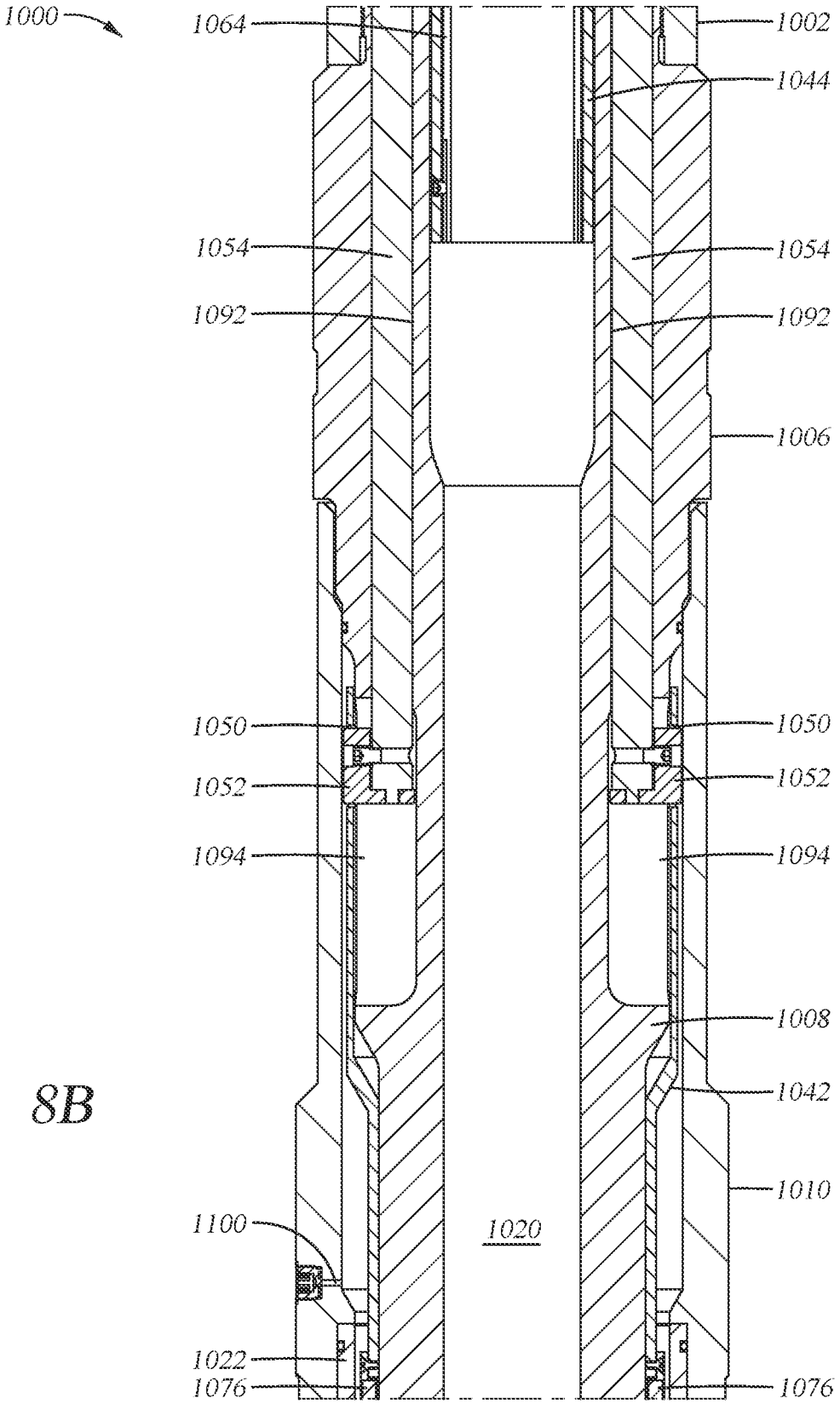

With reference to FIGS. 8A and 8B, pressure inside the central longitudinal flowbore 1020 may be communicated between the adaptor sleeve 1044 and the adaptor skirt 1064, and/or between the adaptor skirt 1064 and the bulkhead 1006, to the activation chamber 1088. Because of the seals between the elongate member(s) 1054 and the secondary bore(s) of the bulkhead 1006, the pressure in the activation chamber 1088 may not be communicated through the secondary bore(s) of the bulkhead 1006. Pressure in the activation chamber 1088 acts on one side of the adaptor piston 1062. Pressure external to the debris collection tool 1000, communicated through the port(s) 1084 acts on an opposing side of the adaptor piston 1062. When a force on the adaptor piston 1062 resulting from the pressure in the activation chamber 1088 exceeds an opposing force on the adaptor piston 1062 resulting from the pressure external to the debris collection tool 1000, the adaptor piston 1062 will experience a net force urging the adaptor piston 1062 to move longitudinally away from the bulkhead 1006. FIG. 8A shows the adaptor piston 1062 having moved to a position at which the debris collection tool 1000 is in the activated configuration.

Still referring to FIGS. 8A and 8B, when the adaptor piston 1062 moves longitudinally, the adaptor extension 1068 and the adaptor skirt 1064 may move in the same direction. When the adaptor skirt 1064 moves longitudinally, the adaptor sleeve 1044 may move in the same direction. When the adaptor sleeve 1044 moves longitudinally, the yoke 1056 of the linkage 1046 may move in the same direction. When the yoke 1056 moves longitudinally, the elongate member(s) 1054 may move in the same direction with respect to the bulkhead 1006, and the key(s) 1052 may move longitudinally within the slot(s) of the mandrel 1008. Longitudinal movement of the key(s) 1052 may cause the inner sleeve 1042 to move in the same direction.

Figure 8C:
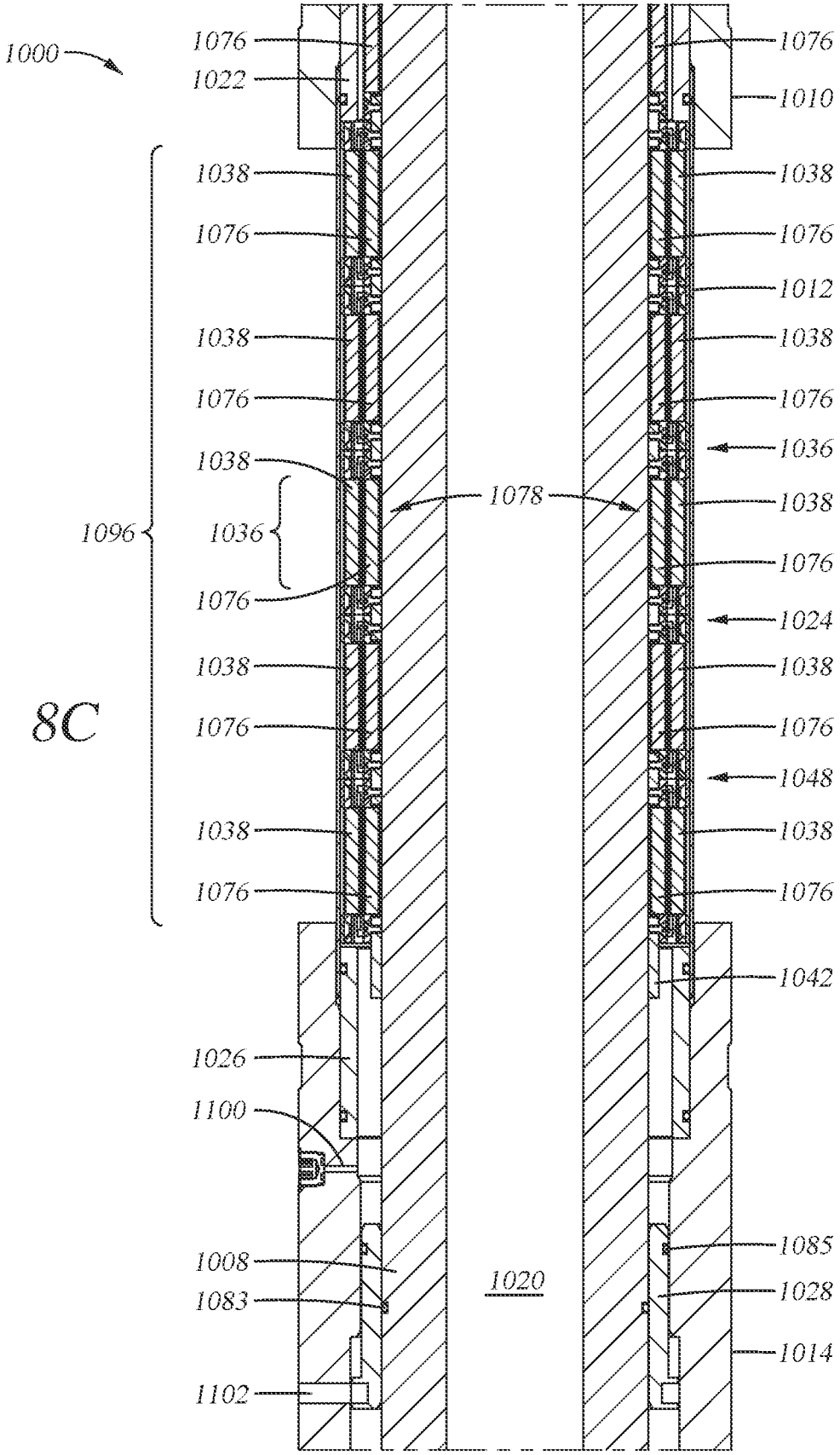
Figure 8D:
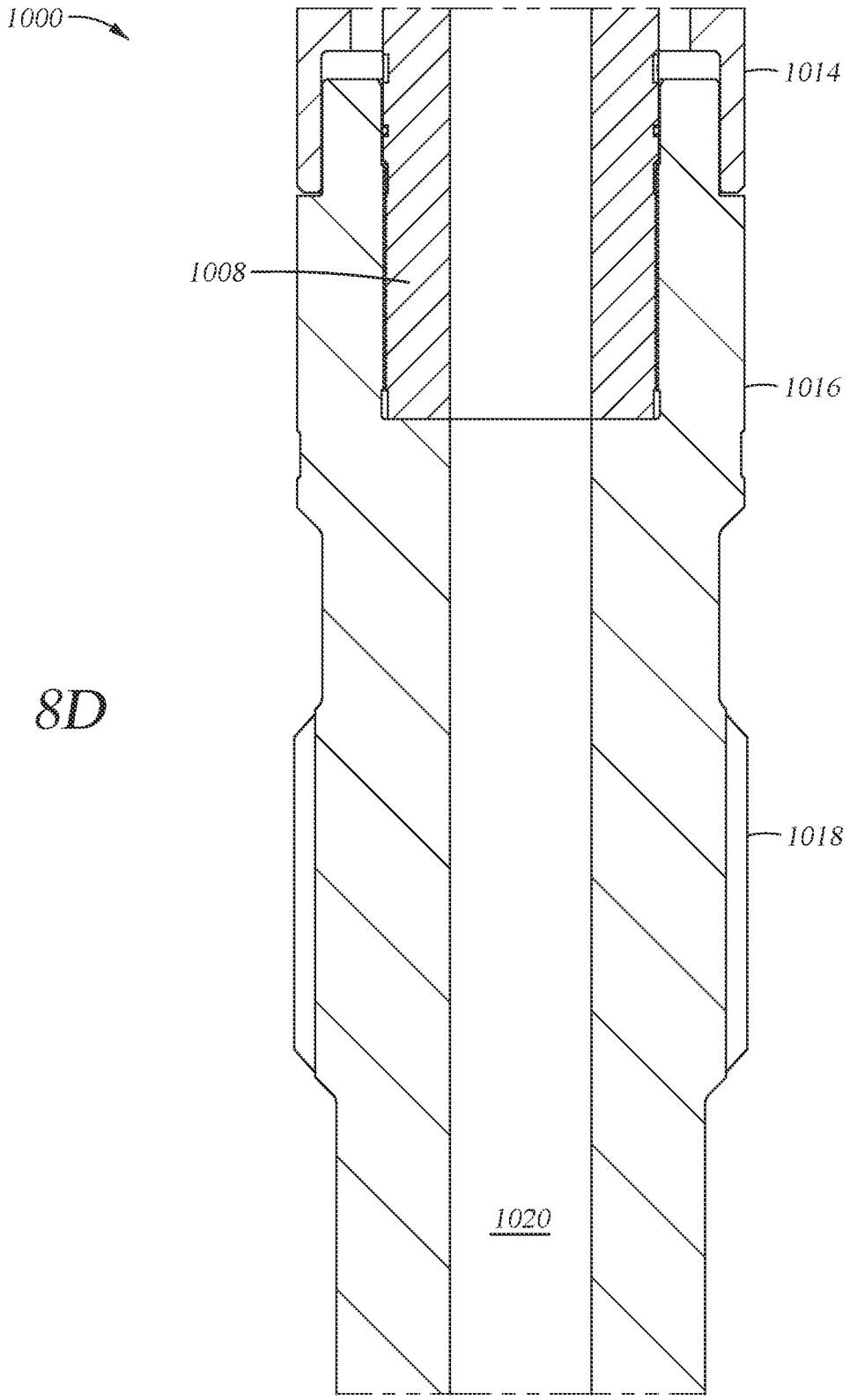

With reference to FIGS. 8B and 8C, longitudinal movement of the inner sleeve 1042 may move the inner magnet array 1048 longitudinally with respect to the outer magnet array 1024, the upper shield 1022, and the lower shield 1026. Rotational alignment of the inner magnet array 1048 with respect to the outer magnet array 1024 may be maintained at least in part by the bridges 1040 of the rings 1036 of outer magnets 1038 interspersed between the inner magnets 1076. Rotational alignment of the inner magnet array 1048 with respect to the outer magnet array 1024 may be maintained at least in part by the bridges 1040 of the rings 1036 of outer magnets 1038 being inserted in the longitudinal grooves 1074 of the inner sleeve 1042. Such longitudinal movement of the inner magnet array 1048 displaces each ring 1078 of inner magnets 1076. Thus, the first ring 1078 of inner magnets 1076 is displaced from a location of radial alignment with the lower shield 1026 to a position whereby each inner magnet 1076 of the first ring 1078 of inner magnets 1076 become radially aligned with a corresponding outer magnet 1038 of the first ring 1036 of outer magnets 1038. Each ring 1078 of inner magnets 1076 may be similarly displaced from radial alignment with one ring 1036 of outer magnets 1038 to become radially aligned with an adjacent ring 1036 of outer magnets 1038. However, in some embodiments, the last ($n+1^{th}$) ring 1078 of inner magnets 1076 may be displaced from radial alignment with the last ($n^{th}$) ring 1036 of outer magnets 1038 to become radially aligned with the upper shield 1022.

Figure 9A:
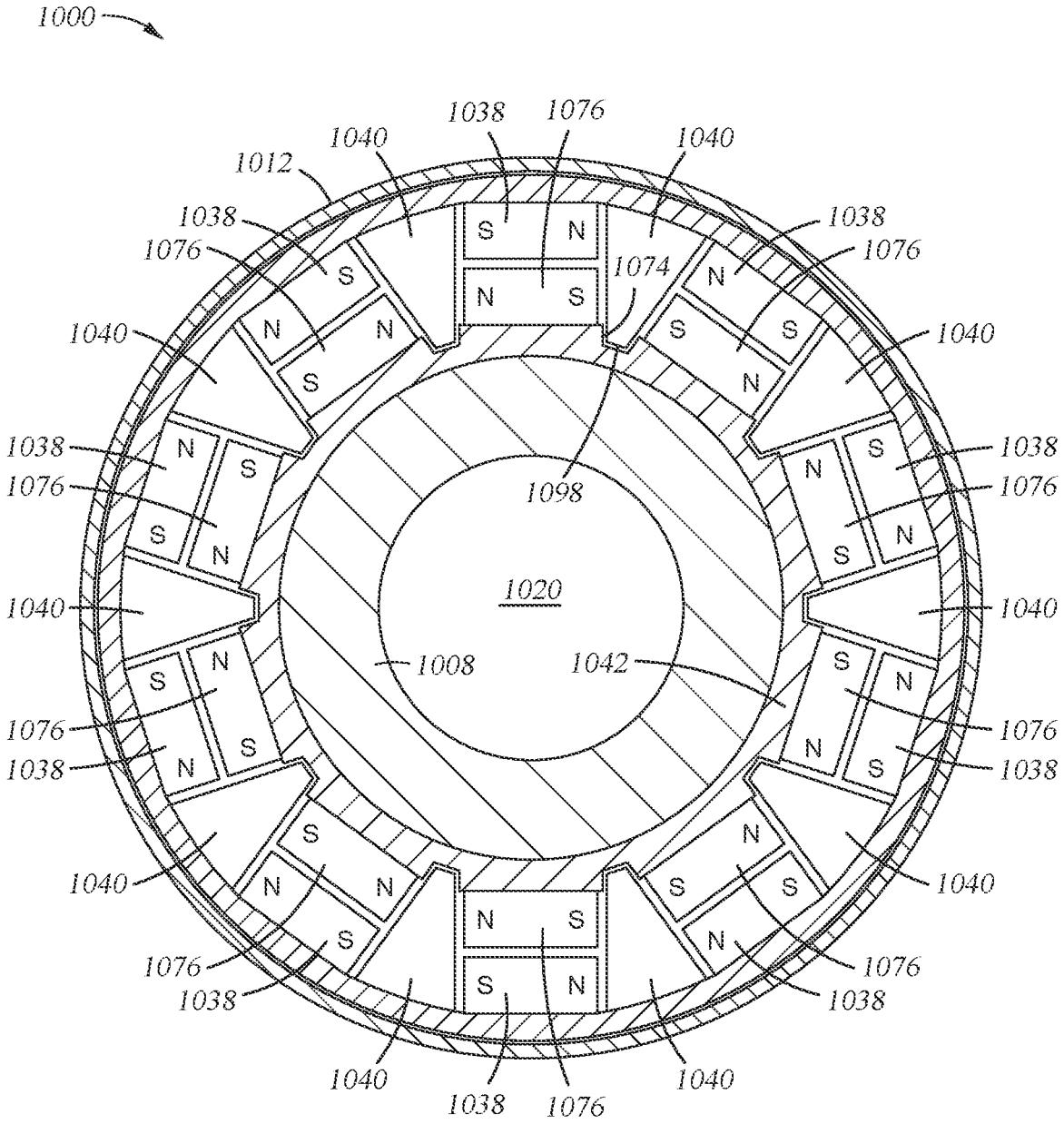
FIGS. 9A and 9B present a lateral cross-section representation of an embodiment of a debris collection tool in an inactive configuration.
Figure 9B:
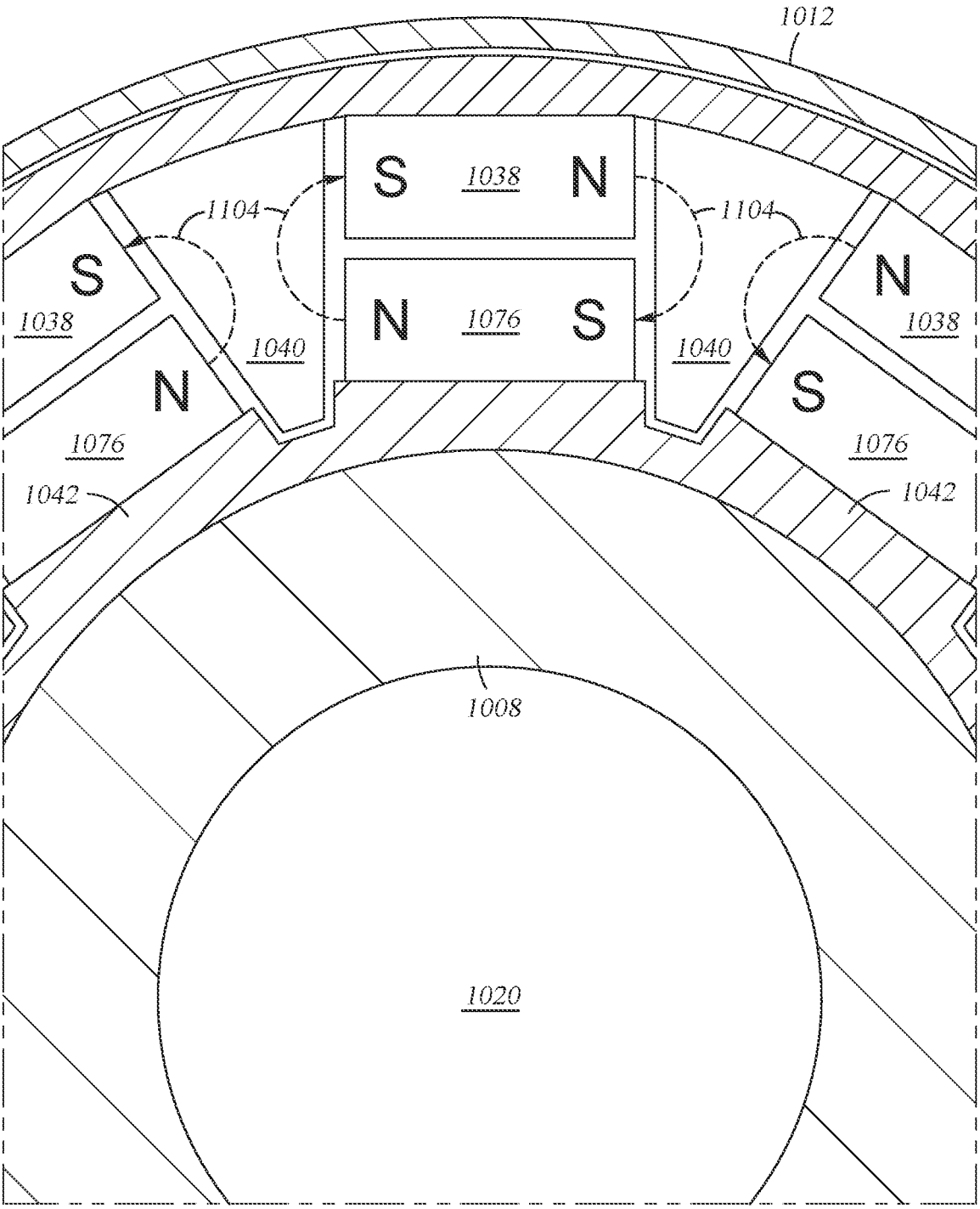

FIG. 9A presents a schematic lateral cross-section of the debris collection tool 1000 to illustrate exemplary juxtapositions of the inner magnets 1076 and the outer magnets 1038 in the inactive configuration. FIG. 9B presents a schematic lateral cross-section of the debris collection tool 1000 to illustrate an exemplary magnetic field resulting from the arrangement shown in FIG. 9A.

FIG. 9A shows a ring 1036 of outer magnets 1038 radially aligned with a ring 1078 of inner magnets 1076. Additionally, each outer magnet 1038 of the ring 1036 of outer magnets 1038 is radially aligned with a corresponding inner magnet 1076 of the ring 1078 of inner magnets 1076. In FIG. 9A, the North pole of each outer magnet 1038 is adjacent to, and radially aligned with, the South pole of a corresponding inner magnet 1076. Similarly, the South pole of each outer magnet 1038 is adjacent to, and radially aligned with, the North pole of a corresponding inner magnet 1076. Additionally, the North pole of each outer magnet 1038 is circumferentially adjacent the North pole of a neighboring outer magnet 1038, and the South pole of each outer magnet 1038 is circumferentially adjacent the South pole of a neighboring outer magnet 1038. Furthermore, the North pole of each inner magnet 1076 is circumferentially adjacent the North pole of a neighboring inner magnet 1076, and the South pole of each inner magnet 1076 is circumferentially adjacent the South pole of a neighboring inner magnet 1076.

As illustrated in FIG. 9B, because of the arrangement described above, a magnetic field 1104 emanating from (for example) the North pole of an outer magnet 1038 is repelled by the North pole of the circumferentially adjacent neighboring outer magnet 1038, but is attracted to the South pole of the radially adjacent neighboring inner magnet 1076. Similarly, a magnetic field 1104 emanating from (for example) the North pole of an inner magnet 1076 is repelled by the North pole of the circumferentially adjacent neighboring inner magnet 1076, but is attracted to the South pole of the radially adjacent neighboring outer magnet 1038. Therefore, the magnetic fields 1104 may be substantially contained in the areas between circumferentially and radially adjacent magnets. Since these areas contain the bridges 1040 of the rings 1036 of outer magnets 1038, and the bridges 1040 may be constructed out of magnetic material, the magnetic fields 1104 may be concentrated in the bridges 1040. Such a concentration of the magnetic fields 1104 may result in the debris collection tool 1000 projecting a weak, negligible, or substantially no, magnetic field into the environment immediately external to the cover 1012. Therefore, when the debris collection tool 1000 is in the inactive configuration, very little, or substantially no, magnetic debris may accumulate in the debris collection zone 1096.

Figure 10A:
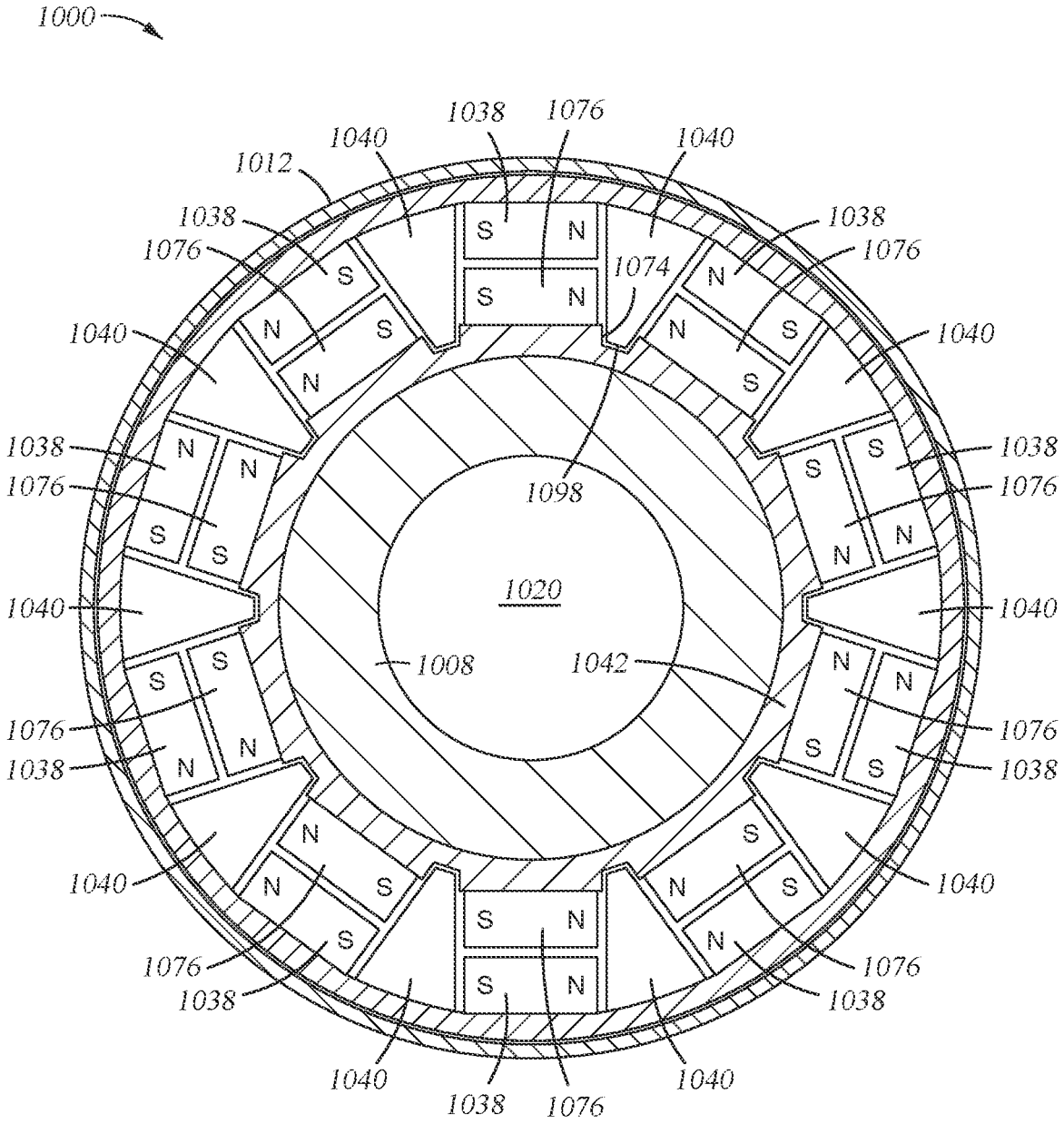
FIGS. 10A and 10B present a lateral cross-section representation of an embodiment of a debris collection tool in an activated configuration.
Figure 10B:
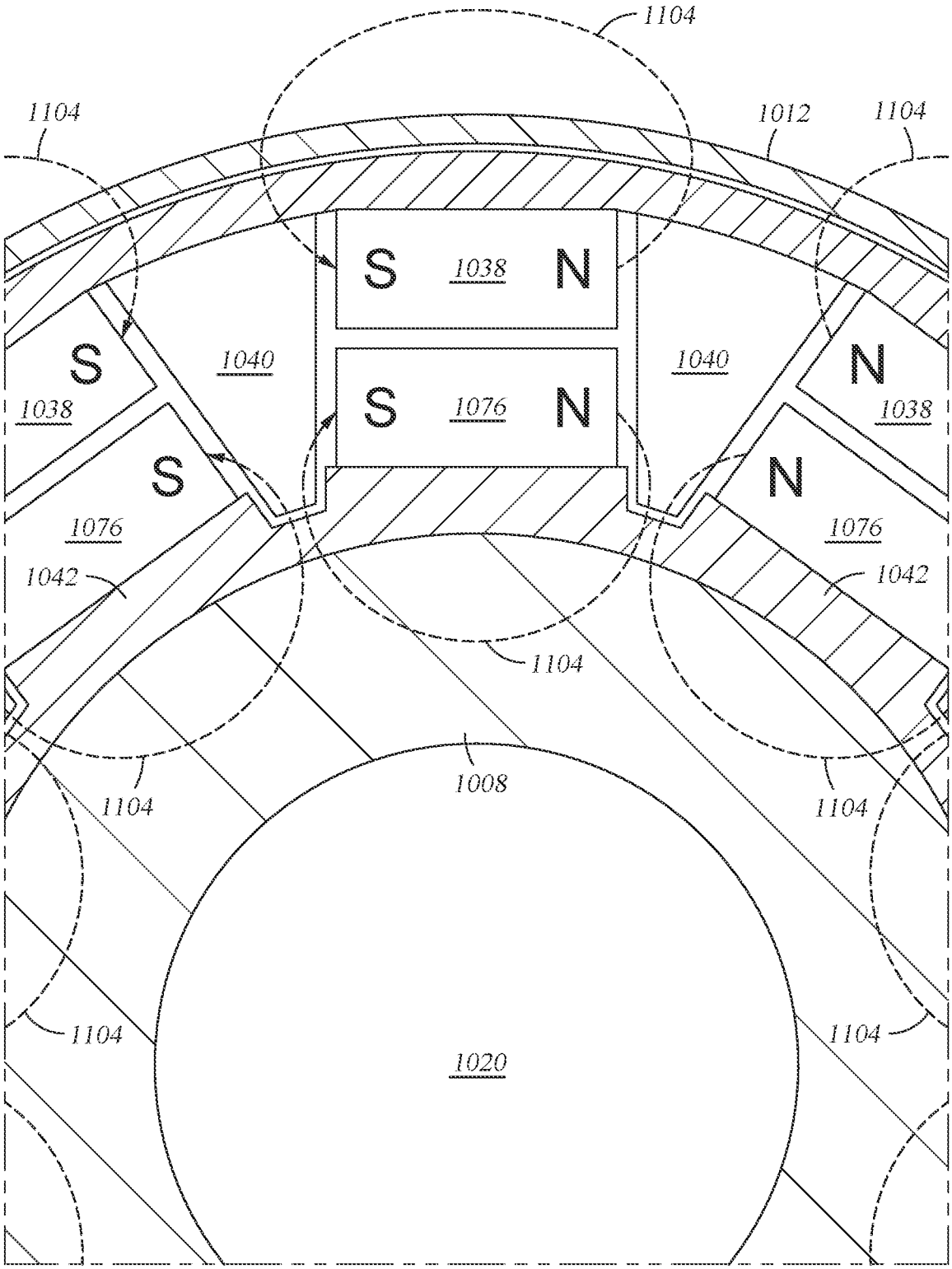

FIG. 10A presents a schematic lateral cross-section of the debris collection tool 1000 to illustrate exemplary juxtapositions of the inner magnets 1076 and the outer magnets 1038 in the activated configuration. FIG. 10B presents a schematic lateral cross-section of the debris collection tool 1000 to illustrate an exemplary magnetic field resulting from the arrangement shown in FIG. 10A.

For the purposes of illustration, the ring 1036 of outer magnets 1038 in FIG. 10A is the same ring 1036 of outer magnets 1038 in FIG. 9A. However, because the inner sleeve 1042 with the inner magnet array has moved longitudinally, the ring 1078 of inner magnets 1076 of FIG. 9A has been replaced by a new ring 1078 of inner magnets 1076 that is axially adjacent to the ring 1078 of inner magnets 1076 of FIG. 9A. Thus, if the ring 1078 of inner magnets 1076 of FIG. 9A is the $r^{th}$ ring 1078 of inner magnets 1076, the new ring 1078 of inner magnets 1076 of FIG. 10A would be the $r-1^{th}$ ring 1078 of inner magnets 1076.

Consistent with the ring 1078 of inner magnets 1076 in FIG. 9A, the North pole of each inner magnet 1076 in FIG. 10A is circumferentially adjacent the North pole of a neighboring inner magnet 1076, and the South pole of each inner magnet 1076 is circumferentially adjacent the South pole of a neighboring inner magnet 1076. In contrast to FIG. 9A, however, FIG. 10A shows that the North pole of each outer magnet 1038 is adjacent to, and radially aligned with, the North pole of a corresponding inner magnet 1076. Similarly, the South pole of each outer magnet 1038 is adjacent to, and radially aligned with, the South pole of a corresponding inner magnet 1076.

As illustrated in FIG. 10B, because of the arrangement described above, a magnetic field 1104 emanating from (for example) the North pole of an outer magnet 1038 is repelled by the North pole of the circumferentially adjacent neighboring outer magnet 1038, and is repelled by the North pole of the radially adjacent neighboring inner magnet 1076. Therefore, the magnetic fields 1104 are not substantially contained in the areas between circumferentially and radially adjacent magnets. Instead, the magnetic field 1104 created by each outer magnet 1038 may extend from the North pole of the outer magnet 1038 outward through the cover 1012 into the environment external to the debris collection tool 1000, and return through the cover 1012 to the South pole of the outer magnet 1038. The relative lack of containment of the magnetic fields 1104 in the areas between circumferentially and radially adjacent magnets may cause the magnetic field 1104 in the environment external to the debris collection tool 1000 to be relatively strong compared to when the debris collection tool 1000 is in the inactive configuration. Therefore, when the debris collection tool 1000 is in the activated configuration, magnetic items in the environment external to the debris collection tool 1000 may be attracted to the debris collection zone 1096, and magnetic debris may accumulate in the debris collection zone 1096.

As shown in FIG. 10B, a magnetic field 1104 may pass through the mandrel 1008. In some embodiments, the mandrel 1008 may be constructed out of a magnetic material, and may have a sufficiently large wall thickness such that the magnetic field experienced in the central longitudinal flowbore 1020 through the mandrel 1008 may be relatively weak. Hence, a propensity for magnetic particles to accumulate in the central longitudinal flowbore 1020 through the mandrel 1008 may be mitigated.

In use, the debris collection tool 1000 may be coupled to a workstring. In some embodiments, the debris collection tool 1000 may be coupled to a workstring to which one or more additional tool may be coupled. The additional tool(s) may include, without limitation, any one or more of a cutting tool, a scraping tool, a perforating tool, a drilling tool, a milling tool, a motor, an explosive tool, a jetting tool, a filter tool, a circulation diverting tool, a packer, a packer setting tool, a bridge plug, a bridge plug setting tool, a liner expansion tool, a cementing tool, a pressure testing tool, an inflow testing tool, a pressure surge mitigation tool, a seat for a ball or dart, a catcher for a ball or dart, a fishing tool, a disconnect tool, a data gathering tool, a data recording tool, a telemetry tool, or combination(s) thereof.

Figure 11:
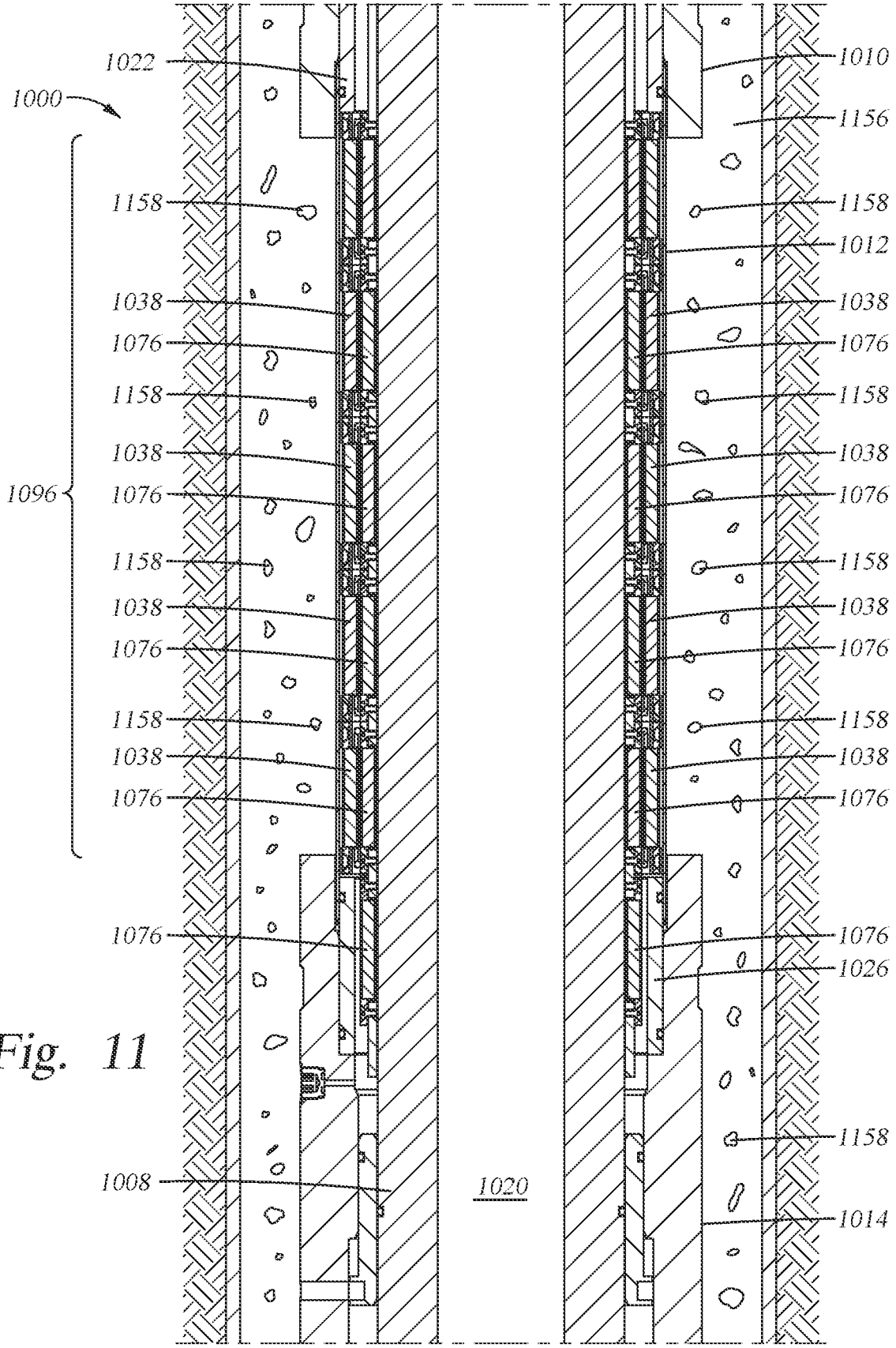
FIG. 11 is a longitudinal cross-section of part of an embodiment of a debris collection tool in a wellbore, with the debris collection tool in an inactive configuration.

The workstring with the debris collection tool 1000 may be inserted into a wellbore. As shown in FIG. 11, the debris collection tool 1000 may be initially in the inactive configuration upon insertion in the wellbore 1156. If present, other tools on the workstring may be actuated in the wellbore 1156 while the debris collection tool 1000 is in the inactive configuration. As shown in FIG. 11, magnetic particles 1158 may not accumulate in the debris collection zone 1096. The debris collection tool 1000 may be transitioned to the activated configuration while in the wellbore 1156.

As described above, the debris collection tool 1000 may be transitioned to the activated configuration by the application of pressure in the central longitudinal flowbore 1020. Such pressurizing may be achieved by pumping a fluid through the workstring into the central longitudinal flowbore 1020. The pressurizing may be assisted by pumping the fluid through a nozzle below the debris collection tool 1000, such that the flow of the fluid through the nozzle creates a back pressure that is experienced in the central longitudinal flowbore 1020. The pressurizing may be assisted by landing a blocking object, such as a ball or a dart, on a seat below the activation chamber 1088 of the debris collection tool 1000. The seat may be part of the debris collection tool 1000, or may be positioned below the debris collection tool 1000. The blocking object may substantially obstruct the passage of fluid therearound, and thus further pumping of fluid after the blocking object lands on the seat will increase the pressure in the workstring and in the longitudinal flowbore of the debris collection tool 1000.

Figure 12:
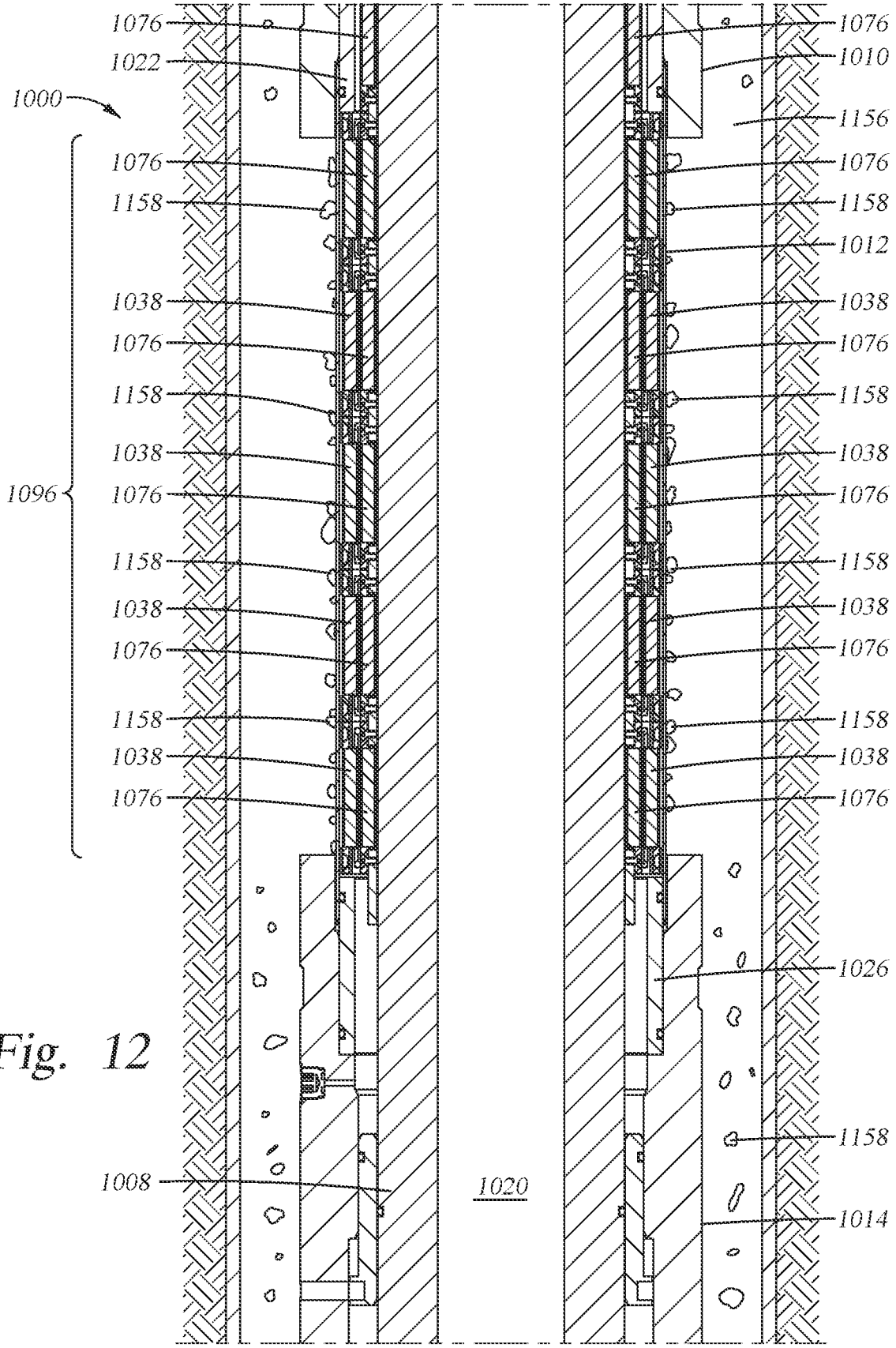
FIG. 12 is a longitudinal cross-section of the embodiment of FIG. 11 in a wellbore, with the debris collection tool in in an activated configuration.

Once transitioned into the activated configuration, the debris collection tool 1000 may now attract magnetic particles 1158 to the debris collection zone 1096, as shown in FIG. 12. The debris collection tool 1000 may remain in the activated configuration while other tools on the workstring are actuated. The debris collection tool 1000 may remain in the activated configuration while the workstring and the debris collection tool 1000 are retrieved from the wellbore 1156.

Figure 13:
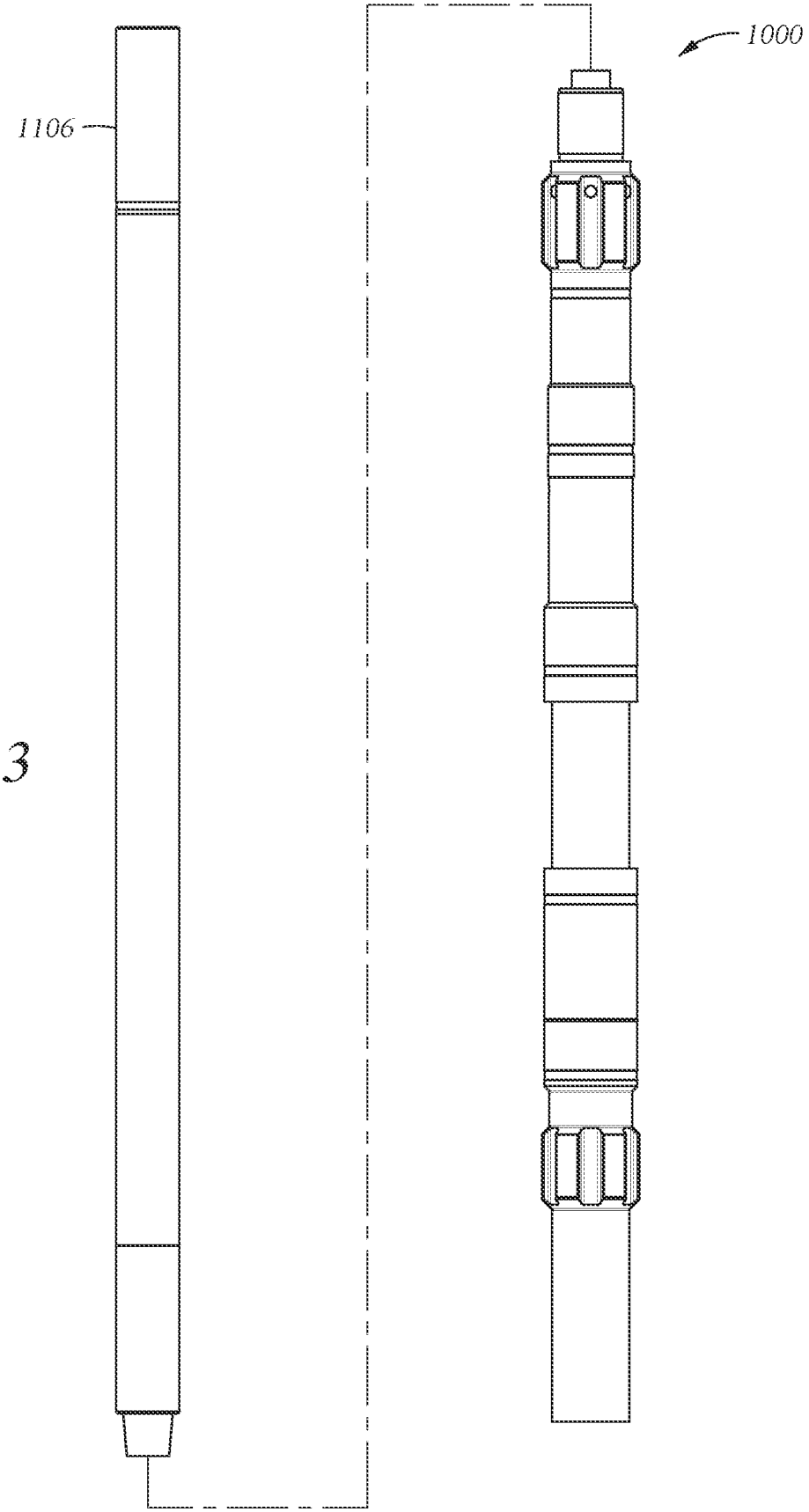
FIG. 13 shows an embodiment of a debris collection tool coupled to a controller.

The debris collection tool 1000 may be coupled to a controller for use in a wellbore 1156. FIG. 13 shows a controller 1106 with a debris collection tool 1000. The controller 1106 may be configured to couple to an upper end of the upper housing 1002 of the debris collection tool 1000. A control sleeve (not shown) in the controller 1106 may be configured to couple to the adaptor extension 1068 or to the adaptor piston 1062 of the debris collection tool 1000.

In some embodiments, the controller 1106 may selectively prevent or allow movement of the adaptor sleeve 1044, thereby selectively preventing or allowing the debris collection tool 1000 to transition between inactive and activated configurations. The controller 1106 may switch between preventing and allowing the debris collection tool 1000 to transition between inactive and activated configurations upon being triggered. In some embodiments, the controller 1106 may be triggered by landing a dropped object on a seat, such as per a controller depicted in U.S. Pat. No. 8,540,035, the disclosure of which is incorporated herein by reference.

In some embodiments, the controller 1106 may be triggered by telemetry of a signal. The signal may be conveyed to the controller 1106 by any one of: a RFID tag; electronically through a wire; electromagnetically; acoustically through a fluid, such as a fluid pressure pulse; acoustically through the workstring or a casing of a wellbore 1156; fluid flow modulation; workstring manipulation, such as rotation and/or axial movement; or combination(s) thereof. The controller 1106 may operate similarly to any of the controllers depicted in U.S. Pat. Nos. 8,540,035; 9,115,573; 9,382,769; and 10,087,725; the disclosures of which are incorporated herein by reference.

Hence, the debris collection tool 1000 may be maintained in the inactive configuration by the controller 1106 even if the debris collection tool 1000 experiences a pressure in the longitudinal flowbore that otherwise would be sufficient to trigger the debris collection tool 1000 to transition into the activated configuration. Therefore, the controller 1106 may prevent premature activation of the debris collection tool 1000 while other operations (such as cutting, scraping, milling, packer setting, pressure testing, fishing, etc.) are being conducted using the workstring and any other tools coupled to the workstring. When it is desired to activate the debris collection tool 1000, the controller 1106 may be prompted by any of the techniques described above and in the above-cited references to permit upward movement of the adaptor sleeve 1044, and any attached components of the adaptor assembly 1060. Then, the application of sufficient pressure in the longitudinal flowbore of the debris collection tool 1000 may activate the debris collection tool 1000, as described above.

Figure 14:
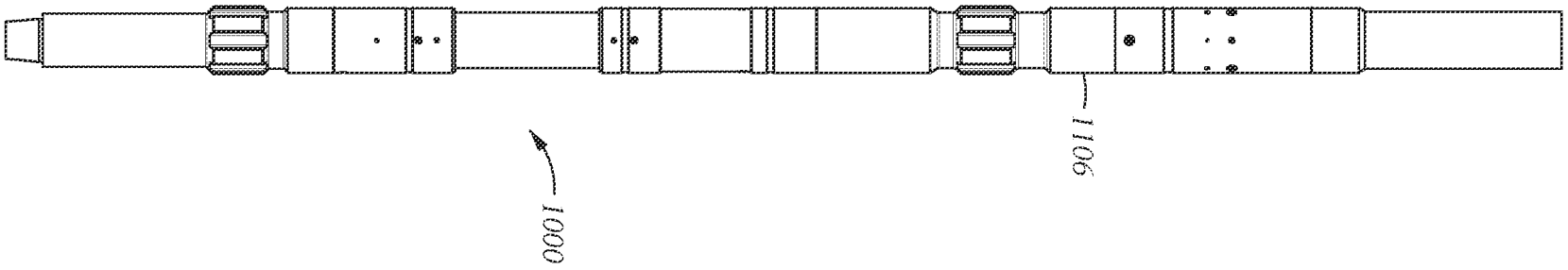
FIG. 14 shows an embodiment of a debris collection tool coupled to a controller.

FIG. 14 shows a controller 1106 with the debris collection tool 1000. The controller 1106 may selectively prevent or allow movement of the adaptor sleeve 1044, thereby selectively preventing or allowing the debris collection tool 1000 to transition between inactive and activated configurations. The controller 1106 may be configured to switch selectively between preventing and allowing the transition of the debris collection tool 1000 without requiring the use of a blocking object landing on a seat and without requiring the use of telemetry. The controller 1106 may be configured to couple to the bulkhead 1006 of the debris collection tool 1000. Hence, the upper housing 1002 and upper centralizer 1004 may be omitted from the debris collection tool 1000.

Figure 15:
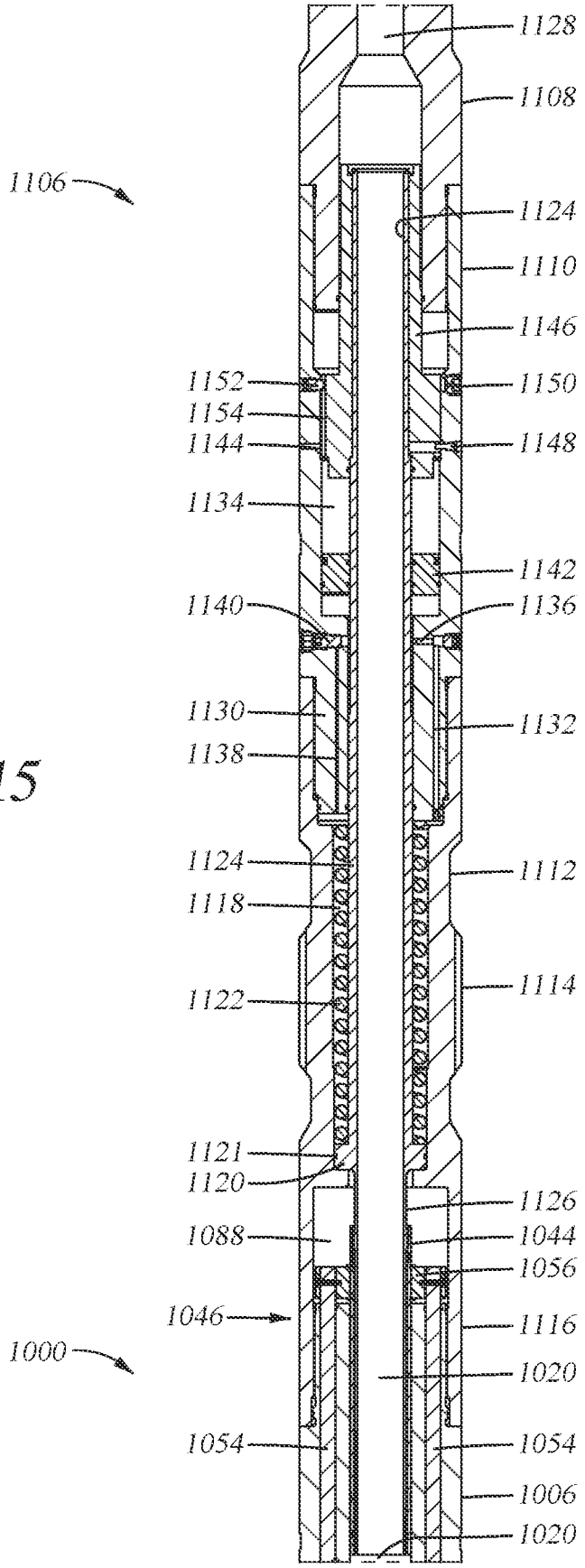
FIG. 15 is a longitudinal cross-section of the controller of FIG. 14 and an upper part of a debris collection tool coupled to the controller, with the debris collection tool in an inactive configuration.
Figure 16:
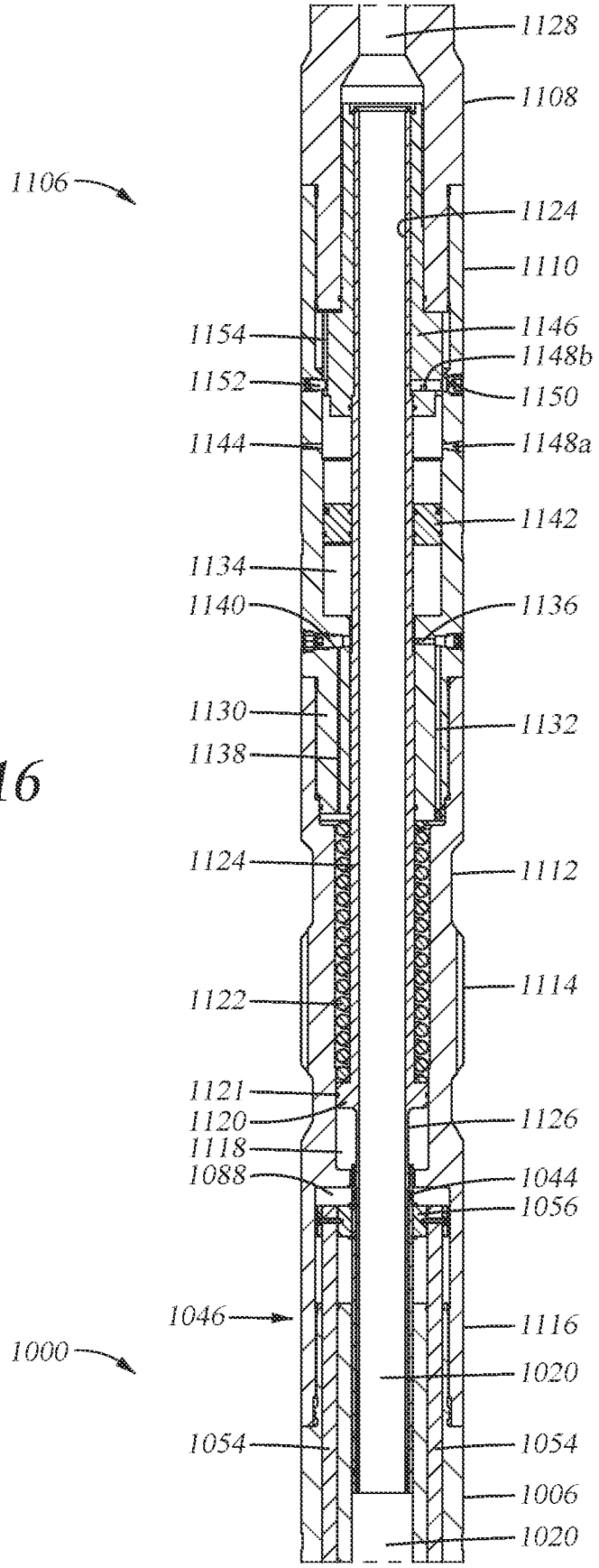
FIG. 16 shows the assembly of FIG. 15 with the debris collection tool in an activated configuration.

FIGS. 15 and 16 show a longitudinal cross-sectional view of the controller 1106 of FIG. 14 together with an upper portion of the debris collection tool 1000. FIG. 15 illustrates components of the controller 1106 when the debris collection tool 1000 is in the inactive configuration. FIG. 16 illustrates components of the controller 1106 when the debris collection tool 1000 is in the activated configuration.

Turning to FIG. 15, the controller 1106 may have a top sub 1108 coupled to a block housing 1110. In some embodiments, the top sub 1108 and the block housing 1110 may be integrally formed. The block housing 1110 may be coupled to a piston housing 1112. The piston housing 1112 may include a centralizer 1114. The piston housing 1112 may be coupled to a bottom sub 1116. In some embodiments, as shown in FIG. 15, the piston housing 1112 and the bottom sub 1116 may be integrally formed. The bottom sub 1116 may be coupled to the debris collection tool 1000. As shown in FIG. 15, the bottom sub 1116 may be coupled to the bulkhead 1006 of the debris collection tool 1000.

The piston housing 1112 may have a piston chamber 1118. A control piston 1120 may be located inside the piston chamber 1118. One or more seal 1121 may inhibit the passage of fluid between the control piston 1120 and an inner wall of the piston chamber 1118. The control piston 1120 may be positioned proximate to a lower end of the piston chamber 1118. A biasing member 1122, such as a spring, may inhibit the control piston 1120 from moving axially away from the lower end of the piston chamber 1118. The control piston 1120 may be coupled to a piston sleeve 1124 that extends from the control piston 1120, through the piston chamber 1118, and into the block housing 1110. In some embodiments, the control piston 1120 and the piston sleeve 1124 may be integrally formed. The control piston 1120 may be coupled to an extension sleeve 1126 that extends from the control piston 1120 into the bottom sub 1116. In some embodiments, the control piston 1120 and the extension sleeve 1126 may be integrally formed. The adaptor sleeve 1044 of the debris collection tool 1000 may be coupled to the extension sleeve 1126. The adaptor sleeve 1044 may be coupled to the extension sleeve 1126 in a similar manner to the coupling between the adaptor sleeve 1044 and the adaptor skirt 1064, illustrated in FIGS. 7A and 7B.

In some alternative embodiments, the adaptor sleeve 1044 may be coupled to the adaptor extension 1068, and the adaptor extension 1068 may be coupled to the extension sleeve 1126. The adaptor sleeve 1044 may be coupled to the adaptor extension 1068 in a similar manner to the coupling between the adaptor sleeve 1044 and the adaptor skirt 1064, illustrated in FIGS. 7A and 7B.

As illustrated in FIG. 15, a central longitudinal flowbore 1128 of the controller 1106 may extend from the top sub 1108, through the piston sleeve 1124, control piston 1120 and extension sleeve 1126, and be fluidically coupled to the central longitudinal flowbore 1020 of the debris collection tool 1000.

As illustrated in FIG. 15, because the bottom sub 1116 of the controller 1106 is coupled to the bulkhead 1006 of the debris collection tool 1000, the activation chamber 1088 of the debris collection tool 1000 is defined at least in part by the bottom sub 1116 and the bulkhead 1006. A bottom side of the control piston 1120 may be fluidically coupled to the activation chamber 1088.

The portion of the piston chamber 1118 above the control piston 1120 and between an external surface of the piston sleeve 1124 and an internal surface of the piston housing 1112, may contain a control fluid, such as a hydraulic oil. The piston chamber 1118 may be bounded at an upper end by a valve block 1130 of the block housing 1110. The valve block 1130 may separate the piston chamber 1118 from an upper chamber 1134 of the block housing 1110. A transfer bore 1132 in the valve block 1130 may provide a fluid pathway between the piston chamber 1118 and the upper chamber 1134. The transfer bore 1132 may have a check valve 1136. The check valve 1136 may allow the passage of control fluid from the piston chamber 1118 to the upper chamber 1134, but inhibit the passage of control fluid from the upper chamber 1134 to the piston chamber 1118. A reset bore 1138 in the valve block 1130 may provide a fluid pathway between the piston chamber 1118 and the upper chamber 1134. The reset bore 1138 may have a stop valve 1140. The stop valve 1140 may be adjustable to selectively allow or inhibit the passage of control fluid from the piston chamber 1118 to the upper chamber 1134, and the passage of control fluid from the upper chamber 1134 to the piston chamber 1118. In some embodiments, the stop valve 1140 may be a removable plug.

The upper chamber 1134 may contain a balance piston 1142. The balance piston 1142 may be sealed against an inner surface of the block housing 1110 and an outer surface of the piston sleeve 1124 that extends through the block housing 1110, and therefore separates the upper chamber 1134 into upper and lower portions. Hence, the transfer bore 1132 and the reset bore 1138 of the valve block 1130 may be fluidically coupled with the lower portion of the upper chamber 1134. The block housing 1110 may have a port 1144 that allows the pressure of fluid external to the block housing 1110 to be communicated to the upper portion of the upper chamber 1134.

A piston block 1146 may be coupled to and around the piston sleeve 1124 within the upper chamber 1134. The piston block 1146 may be configured to move axially as a result of the piston sleeve 1124 moving axially. The piston block 1146 may be temporarily retained in a first position by a fastener 1148, such as a latch, locking dog, collet, snap ring, shear ring, shear screw, shear pin, or the like. The fastener 1148 may temporarily secure the piston block 1146 to the block housing 1110. Thus, the piston block 1146, piston sleeve 1124, control piston 1120, and extension sleeve 1126 may be temporarily inhibited from moving axially. As a result of this, the adaptor sleeve 1044 may be temporarily inhibited from moving axially, and therefore the debris collection tool 1000 may be temporarily maintained in the inactive configuration. In some embodiments, the fastener 1148 may be omitted. Nevertheless, the piston block 1146, piston sleeve 1124, control piston 1120, and extension sleeve 1126 may be temporarily inhibited from moving axially upward because of a downward force produced by the biasing member 1122 and the pressure of the control fluid in the piston chamber 1118. Hence, in use, when coupled to a workstring, the debris collection tool 1000 may be maintained in the inactive configuration while the workstring and other tools coupled to the workstring may be operated by fluid pressures that otherwise would transition the debris collection tool 1000 to the activated configuration. Thus, the debris collection may be selectively transitioned from the inactive configuration to the active configuration.

In order to transition the debris collection tool 1000 to the activated configuration, an activation pressure may be applied in the central longitudinal flowbore 1020 of the debris collection tool 1000. As described above, pressure applied in the central longitudinal flowbore 1020 of the debris collection tool 1000 may be communicated around the adaptor sleeve 1044 to the activation chamber 1088. The pressure in the activation chamber 1088 may be communicated to the bottom of the control piston 1120 of the controller 1106, resulting in the control piston 1120 experiencing an upwardly-directed force. This upwardly-directed force may be counteracted by the downward force produced by the biasing member 1122 and the pressure of the control fluid in the piston chamber 1118. In embodiments that include the fastener 1148, the upwardly-directed force on the control piston 1120 is also resisted by the fastener 1148. By increasing the pressure in the central longitudinal flowbore 1020 of the debris collection tool 1000, the pressure in the activation chamber 1088 increases. Thus the pressure on the bottom of the control piston 1120 of the controller 1106 increases, and the upwardly-directed force on the control piston 1120 increases accordingly. When the upwardly-directed force on the control piston 1120 exceeds the resistance provided by the downward force produced by the biasing member 1122 and the pressure of the control fluid in the piston chamber 1118 plus the force required to defeat the fastener 1148 (if present), such as a shear force, the control piston 1120 may begin to move upward.

When the control piston 1120 moves upward, control fluid in the piston chamber 1118 flows through the transfer bore 1132, through the check valve 1136, and into the lower portion of the upper chamber 1134. The balance piston 1142 may therefore move upward, and some of the fluid in the upper portion of the upper chamber 1134 may be vented to an exterior of the controller 1106 through the port 1144. Because the control piston 1120 moves upward, the piston sleeve 1124 and piston block 1146 also move upward. Additionally, the extension sleeve 1126 moves upward, as does the adaptor sleeve 1044 of the debris collection tool 1000 to which the extension sleeve 1126 is coupled. As described above, this results in the linkage 1046 moving upward, and thus the inner sleeve 1042 and inner magnet array 1048 of the debris collection tool 1000 also move upward. Hence, the debris collection tool 1000 transitions from the inactive configuration to the activated configuration.

Per the preceding description, FIG. 16 shows the controller 1106 and the upper portion of the debris collection tool 1000 of FIG. 15 when the debris collection tool 1000 has transitioned to the activated configuration. Although the application of pressure in the central longitudinal flowbore 1020 of the debris collection tool 1000 is required to transition the debris collection tool 1000 to the activated condition, the pressure need not be maintained in order to retain the debris collection tool 1000 in the activated condition. Upon reducing the pressure in the central longitudinal flowbore 1020 of the debris collection tool 1000, the control piston 1120 may experience a net downward force from the biasing member 1122 and any residual pressure of the control fluid in the piston chamber 1118. However, the control piston 1120 may be pressure-locked because the control fluid in the lower portion of the upper chamber 1134 is inhibited from transferring back into the piston chamber 1118. The stop valve 1140 inhibits fluid flow through the reset bore 1138, and the check valve 1136 inhibits fluid flow back into the piston chamber 1118 through the transfer bore 1132. Thus, once the debris collection tool 1000 has been transitioned to the activated configuration, the controller 1106 may resist the influence of further operational pressure fluctuations and manipulations, hence maintaining the debris collection tool 1000 in the activated configuration. Accordingly, an inadvertent transition of the debris collection tool 1000 back to the inactive configuration, which would result in the release of accumulated particles, may be avoided. Therefore, magnetic debris may accumulate in the debris collection zone 1096, and may remain in place while the debris collection tool 1000 is retrieved from the wellbore 1156.

When the controller 1106 and debris collection tool 1000 are retrieved from a wellbore 1156, the debris collection tool 1000 may be transitioned back to the inactive configuration to allow for the accumulated debris to be released, and to allow for the debris collection tool 1000 to be run anew into the wellbore 1156. Furthermore, the controller 1106 may be reset.

As shown in FIG. 16, the fastener 1148 has been defeated, and in this case has become separated into two pieces 1148*a* and 1148*b*. The pieces 1148*a* and 1148*b* may be removed, and the fastener 1148 may be replaced once the controller 1106 has been reset. The piece 1148*a* remaining in a wall of the block housing 1110 may be removed by conventional methods. The piece 1148*b* in the piston block 1146 may be removed through an access port 1150. Alignment between the piston block 1146 and the access port 1150 may be maintained by an alignment key 1152 in a wall of the block housing 1110 interacting with an alignment slot 1154 in the piston block 1146.

To reset the controller 1106 and transition the debris collection tool 1000 back to an inactive configuration, a flow path may be established for the control fluid to travel from the lower portion of the upper chamber 1134 to the piston chamber 1118, thereby releasing the control piston 1120 from the hydraulic lock. The establishment of the fluid flow path may be achieved by adjustment of the stop valve 1140 to open the flow path through the reset bore 1138. In some embodiments, the stop valve 1140 may be switched from a closed condition to an open condition. In some embodiments, the stop valve 1140 may be removed. In some embodiments, the stop valve 1140 may be partially removed, sufficiently to open the flow path through the reset bore 1138. Upon opening the flow path through the reset bore 1138, the biasing member 1122 may push the control piston 1120 downward, and control fluid may flow through the reset bore 1138 from the lower portion of the upper chamber 1134 into the piston chamber 1118. When the control piston 1120 has reached the end of its travel, the stop valve 1140 may be adjusted to close the flow path through the reset bore 1138.

Downward movement of the control piston 1120 results in downward movement of the piston block 1146. When the control piston 1120 has reached the end of its travel, a replacement fastener 1148 may be inserted into the piston block 1146. In some embodiments, the replacement fastener 1148 may be omitted. Downward movement of the control piston 1120 also results in downward movement of the extension sleeve 1126, and hence downward movement of the adaptor sleeve 1044 and the linkage 1046 of the debris collection tool 1000. Thus, the inner sleeve 1042 and inner magnet array 1048 of the debris collection tool 1000 also move downward. Hence, the debris collection tool 1000 transitions from the activated configuration to the inactive configuration. Debris accumulated around the debris collection tool 1000 may be cleared from the debris collection tool 1000, and the debris collection tool 1000 may then be run back into the wellbore 1156, if required.

Various embodiments have been described of a debris collection tool and other apparatus associated with a debris collection tool. In one embodiment, a debris collection tool may include a mandrel having a longitudinal flowbore therethrough and an inner sleeve disposed around the mandrel. A first array of magnets may be arranged on the inner sleeve. A second array of magnets may be disposed around the inner sleeve. The debris collection tool further may include an adaptor sleeve concentric with the mandrel and a linkage coupling the adaptor sleeve with the inner sleeve.

In another embodiment, a debris collection tool may include a mandrel having a longitudinal flowbore therethrough and an inner sleeve disposed around the mandrel. A first array of magnets may be arranged on the inner sleeve. The first array of magnets may include a plurality of inner magnets disposed around a circumference of the inner sleeve. The inner sleeve may have a longitudinal groove between two adjacent magnets of the first array of magnets. The debris collection tool further may include a second array of magnets disposed around the inner sleeve. The second array of magnets may include an annular arrangement of magnets between a pair of axially spaced end bands and may include a bridge between two circumferentially adjacent magnets. The bridge may be configured to project into the longitudinal groove. In some embodiments, the debris collection tool further may include an adaptor sleeve concentric with the mandrel and a linkage coupling the adaptor sleeve with the inner sleeve.

In another embodiment, a magnet assembly may include first and second annular end bands and may include an annular arrangement of magnets disposed between the first and second annular end bands. The first and second annular end bands may include substantially a non-magnetic material. The magnet assembly further may include a plurality of bridges. Each bridge may be disposed between the first and second annular end bands and between circumferentially adjacent magnets of the annular arrangement of magnets. The bridges may include substantially a magnetic material.

In another embodiment, a controller for a wellbore tool may include a first housing defining a first chamber, and a second housing coupled to the first housing and defining a second chamber. The controller further may include a valve block separating the first and second chambers. A piston may be axially movable within the first chamber. A sleeve may be coupled to the piston, and may extend from the first chamber into the second chamber through the valve block. A fastener may be coupled to sleeve and may be coupled to the second housing. The controller further may include a central longitudinal flowbore through the sleeve and the piston. A first bore through the valve block may fluidically couple an annulus between the sleeve and the first housing with the second chamber, and a check valve may be associated with the first bore. A second bore through the valve block may fluidically couple an annulus between the sleeve and the first housing with the second chamber, and a stop valve may be associated with the second bore.

While the foregoing is directed to embodiments of the present disclosure, other and further embodiments of the disclosure may be devised without departing from the basic scope thereof, and the scope thereof is determined by the claims that follow.

What is claimed is:

1. A magnetic debris collection tool for use in a subterranean wellbore, the tool comprising:

an inner magnetic array comprising a plurality of axially aligned inner rings, each inner ring comprising an annular arrangement of inner magnets, and wherein each inner magnet of an inner ring is arranged with a north pole facing a north pole of a circumferentially adjacent inner magnet;

an outer magnetic array comprising a plurality of axially aligned outer rings, each outer ring comprising an annular arrangement of outer magnets, and wherein each outer magnet is arranged with a north pole facing a north pole of a circumferentially adjacent outer magnet;

the inner magnetic array axially movable with respect to the outer magnetic array between:

a first position in which the inner magnets of an inner ring are radially aligned with the outer magnets of a first outer ring such that the north pole of each inner magnet is radially adjacent the north pole of an outer magnet; and a second position in which the inner magnets of an inner ring are radially aligned with the outer magnets of a second outer ring such that the north pole of each inner magnet is radially adjacent the south pole of an outer magnet.

2. The magnetic debris collection tool of claim 1, wherein the inner magnetic array is positioned on a sliding sleeve.

3. The magnetic debris collection tool of claim 2, wherein the sleeve is axially movable on a tool mandrel having a longitudinal bore therethrough, and wherein the sleeve is movable in response to a pressure increase in the bore of the mandrel.

4. The magnetic debris collection tool of claim 2, wherein the outer magnetic array further comprises a plurality of longitudinal rods made of magnetic material and extending along the axial length of the plurality of outer magnetic rings, each rod positioned between circumferentially adjacent outer magnets.

5. The magnetic debris collection tool of claim 4, wherein each of the longitudinal rods cooperates with a corresponding longitudinal groove defined in the sliding sleeve.

6. The magnetic debris collection tool of claim 1, wherein each inner magnet of an inner ring is axially aligned with an inner magnet of an adjacent inner ring, and wherein each inner magnet of an inner ring is arranged with a north pole facing a south pole of an axially adjacent inner ring.

7. The magnetic debris collection tool of claim 1, wherein the inner magnetic array is axially movable with respect to the outer magnetic array by a distance equivalent to the height of an inner ring of magnets.

* * * * *